US005680744A

United States Patent [19]

Kramedjian et al.

[11] Patent Number: 5,680,744

[45] Date of Patent: Oct. 28, 1997

[54] MODULAR PRODUCT DISPLAY AND DELIVERY SYSTEM

[76] Inventors: Armand J. Kramedjian, 415 Golfview Dr., Atlanta, Ga. 30309; Terrance Francis O'Brien, 4300 Chimney Lake Dr., Roswell, Ga. 30075

[21] Appl. No.: 741,252

[22] Filed: Oct. 30, 1996

Related U.S. Application Data

[63] Continuation of Ser. No. 197,406, Feb. 16, 1994, Pat. No. 5,597,114.

[51] Int. Cl.[6] ..... B65B 35/50

[52] U.S. Cl. ..... 53/447; 53/445; 53/448

[58] Field of Search ..... 206/503, 504; 53/445, 447, 448, 154, 155, 540, 543

[56] References Cited

U.S. PATENT DOCUMENTS

| | | | |
|---|---|---|---|
| 3,287,075 | 11/1966 | Batke et al. | 206/504 X |
| 3,552,579 | 1/1971 | Simon et al. | 229/915 X |
| 3,592,344 | 7/1971 | Schade | 229/120.01 X |
| 3,749,273 | 7/1973 | Wreghitt et al. | 206/504 X |
| 4,192,562 | 3/1980 | Bishoff et al. | 220/23.6 X |
| 4,592,601 | 6/1986 | Hlinsky et al. | 206/504 X |
| 4,863,222 | 9/1989 | Posso | 206/504 X |
| 5,039,002 | 8/1991 | Spamer | 229/120.08 |
| 5,115,916 | 5/1992 | Beasley et al. | 206/504 X |
| 5,228,590 | 7/1993 | Blasko et al. | 206/504 X |
| 5,330,055 | 7/1994 | Kendra et al. | 206/504 X |

*Primary Examiner*—Daniel Moon

*Attorney, Agent, or Firm*—Louis T. Isaf; Isaf, Vaughan & Kerr

[57] ABSTRACT

Briefly described, the present invention includes a product display and delivery system using uniquely tailored, modular, disposable cartridges. In accordance with the preferred embodiments of the present invention, disposable cartridges having unique features are created from opposed, interlocking sleeves. Also, in accordance with another preferred embodiment of the present invention, disposable cartridges are releasably joined in modular fashion to allow easy stacking, arrangement, and replacement of the cartridges.

2 Claims, 15 Drawing Sheets

MODULAR PRODUCT DISPLAY AND DELIVERY SYSTEM

This application is a continuation of application Ser. No. 08/197,406 filed on Feb. 16, 1994, now U.S. Pat. No. 5,597,114.

BACKGROUND OF THE INVENTION

The present invention relates generally to the field of product displays and, in its most preferred embodiments, to the field of apparatus and methods for point of sale product displays.

The point of sale purchase of products through impulse buying by consumers represents a large volume of sales for many product manufacturers. As a result, many manufacturers have come to rely almost exclusively on the sale of their products at the checkout counters of grocery stores, drug stores, and convenience stores. These manufacturers have simply discovered that impulse buying stems from at least two basic factors. First, at many stores, consumers often spend a great deal of time waiting in line to check out. Second, while they wait in line, consumers can be enticed into impulsively purchasing a product if the product is appealingly displayed at the right location. Therefore, manufacturers seek to locate clever product displays on the checkout counter or in areas immediately adjacent to the checkout counter where consumers wait in line.

Since many manufacturers have made the same discoveries, store owners and managers are bombarded with a large number of manufacturers who wish to display their products for sale in the limited amount of space on and around checkout counters. Of course, the owners of the stores typically receive a percentage of the profit generated from sales of the products through consignment, placement fees, or outright sales. Store owners, therefore, strictly allocate checkout counter space for product displays to maximize the profit per square foot of space. Such strict allocation places checkout counter locations for product displays at a premium and pits manufacturers against one another in a never-ending battle to acquire prime checkout counter space for their displays.

Problems inherent in the currently available product display technology serve to exacerbate the struggle among manufacturers for prime checkout counter space in which to showcase their products for consumers. Typically, product displays are constructed from thick, heavy plastic or opaque cardboard and once constructed, have fixed dimensions and hence, a fixed geometric shape. Vertical space is often poorly used and due to their construction, the product displays cannot usually be modified or stacked without a rack to improve space utilization. As a result, store owners and managers are often prevented from placing many product displays on the checkout counter because their size and shape cannot be changed and as constructed, they simply consume premium space that may be better utilized for hotter-selling products. In the event that a product display is placed on a checkout counter, the fixed size and shape of current product displays may constrain the number of ways that a store owner or manager can aesthetically arrange the multitude of displays that must reside on the checkout counter.

Unfortunately for store owners and managers, the size of a product display is often determined by the underlying way in which a manufacturer utilizes current product display technology. To minimize the cost of display construction, many product manufacturers typically build a display and place it in a store with the intent that the display will remain in the store for a long period of time as a semi-permanent fixture. A route person is then assigned to visit the store periodically and refill the display with product. Because the route person is usually responsible for a number of product displays at different stores and generally cannot check on each display daily, the displays must hold enough product to meet estimated consumer demand between visits by the route person. However, since consumer demand is difficult to estimate accurately, product displays are often larger and hold more product than necessary so that the display does not become empty before the route person returns to replenish the display with product. Therefore, due to the way in which current product display technology is utilized, the product display ends up occupying valuable checkout counter space to store product that probably belongs in a warehouse.

In addition to the size and shape problems related to current product display technology, product manufacturers must also employ route persons to perform the task of replenishing product displays as discussed above. Therefore, manufacturers are faced with the underlying costs of employing route persons either as direct or contract employees. These employment costs, of course, reduce the profits derived from the very impulse purchasing that the manufacturers seek to induce with their product displays.

SUMMARY OF THE INVENTION

Briefly described, the present invention includes a product display and delivery system using uniquely tailored, modular, disposable cartridges. In accordance with the preferred embodiments of the present invention, disposable cartridges having unique features are created from opposed, interlocking sleeves. Also, in accordance with another preferred embodiment of the present invention, disposable cartridges are releasably joined in modular fashion to allow easy stacking, arrangement, and replacement of the cartridges.

In a first preferred embodiment of the apparatus of the present invention, a disposable cartridge is formed by two elongated, rectangular sleeves positioned with the first sleeve residing inside the second sleeve. The first sleeve is oriented so that its four walls provide a top, bottom, and sides for the cartridge. The second sleeve is rotated relative to the first sleeve so that its four walls supply a front, back, and sides for the cartridge. Orienting the sleeves relative to one another in this manner creates a cavity in which individually packaged product is held for removal and impulse purchase by a consumer. In addition, the orientation of the sleeves effectively doubles the thickness of the cartridge side walls, thereby increasing the structural rigidity of the cartridge that naturally results from the folded structure of the cartridge. Removal of product from the cartridge's cavity is accomplished via an access port located in the front wall of the cartridge and is made easier because the product need only pass through a hole in one thickness of material. Though a double thickness front wall is acceptable to the broad invention, the preferred embodiment utilizes a single layer of material in order that the product is not easily caught in the small gap that would exist between the sleeves at the location of the hole. A ramp, formed from the material removed to create the hole, works in conjunction with the hole to enhance the ease of product removal by guiding product packages toward the hole. The ramp also serves to aid in interlocking the two sleeves together.

In accordance with a preferred method of the first preferred embodiment of the present invention, each sleeve of the cartridge is uniquely designed and flat patterned as a multitude of flaps, folds, and surfaces that cooperate, upon assembly, to produce a single, elongated rectangle. Following the flat patterns, each sleeve is cut from a flat sheet of lightweight, flexible material having sufficient structural stiffness to assist the finished cartridge in being self-supporting. The sleeves are then individually folded and assembled with the first sleeve being filled with product before it is inserted into the second sleeve. Upon final folding and securing of the flaps into their pre-designed positions, the two sleeves are interlocked together and form the cartridge. After the ramp is folded into place, labels are applied to the outside of the cartridge to complete assembly.

The product display cartridge is ready for use once assembly is completed. In accordance with a preferred method of the first preferred embodiment of the present invention, the cartridge, already loaded with product, is shipped to a store via a delivery service including, but certainly not limited to, U.S. Mail, overnight courier, or ground freight. Because the product display cartridge is self-supporting, the store owner or manager need only remove the cartridge from the shipping container and immediately place the cartridge in one of a myriad of locations, including a checkout counter. No support rack or other support structure is required. Owing additionally to its lightweight construction, the cartridge is easily fastened to a fixed feature of the store, for instance, a cash register, after applying double-sided tape to its back and pressing the cartridge against the fixture. In addition, since the cartridge is already loaded with product, it is ready for immediate use by consumers without the intervention of a route person as is currently required for many product displays. Over a period of time, consumers remove product from the cartridge until it becomes empty. The store owner or manager then simply disposes of (or recycles) the cartridge, retrieves a new, fully loaded cartridge from a storeroom (or orders one to be delivered by overnight courier), and places the new cartridge in the same location formerly occupied by the empty cartridge. Using this method, the amount of product on display at any given time is limited to the amount of product required for immediate consumption by store patrons, thereby overcoming the unnecessary consumption of space by current over-sized product displays that act as warehouses for product.

The unique, flexible nature of the present invention lends itself to an endless number of other preferred embodiments using similar apparatus and methods to accommodate a variety of different products and package sizes. For the sake of brevity, this application discloses only those embodiments that add other inventive features including, but not limited to, cartridge inserts, side slits, and lip assemblies. For instance, in a second preferred embodiment of the apparatus of the present invention, a false back insert is positioned within the cavity defined by the two interlocking sleeves of the first preferred embodiment of the present invention. The false back allows product in packages smaller than those allowed by the first embodiment to be displayed and dispensed, while maintaining the same depth for the cartridge. Several other inventive features are introduced in third and fourth preferred embodiments of the apparatus of the present invention. First, a side slit is employed to enhance customer access to the individually packaged bottles displayed and dispensed by the cartridge. Second, a back bottle ramp insert is included to perform the same space-filling function as the false back insert described above, but also to assist in feeding the last few bottles toward the front of the cartridge for easy customer access. Still other inventive features are presented in a fifth preferred embodiment of the apparatus of the present invention. There, a center divider is added with false back and false bottom ramp inserts to promote smooth feeding of small, lightweight bottles toward the front of the cartridge. In addition, a front lip assembly is incorporated on the outside of the cartridge to stop the bottles from spilling out of the cartridge and to improve customer access. As can be seen from this limited sample of potential embodiments, the present invention, while following certain generic inventive concepts, is amoeba-like and is embodied in a variety of different inventive forms (i.e. species) to display or dispense different products.

Because each preferred embodiment of the apparatus of the present invention is slightly different than the first preferred embodiment, the preferred methods associated with each preferred embodiment are slightly different as well. These differences are discussed only briefly here. More detailed descriptions of the preferred methods are included in the detailed description of the drawings that follows. In all of the preferred embodiments, each sleeve is designed, flat patterned, cut, and individually assembled as discussed in accordance with a preferred method for the first preferred embodiment of the present invention. Where inserts are required in an embodiment, the inserts are designed and patterned as a multitude of flaps, folds, and surfaces that cooperate with the sleeves of the cartridge. After being cut from a flat sheet of material, the inserts are folded and positioned inside the first sleeve before its insertion into the second sleeve. Where side slits and front lip assemblies are required in an embodiment, minor changes are made to the design and pattern of flaps, folds, and surfaces that comprise the sleeves of the cartridge. In some embodiments, additional cutting and folding is required during assembly of the sleeves as well. In addition, because a front lip assembly is essentially an insert that attaches to the outside of the cartridge, it is designed and patterned like an insert as a multitude of flaps, folds, and surfaces. Unlike an insert though, a front lip assembly is cut and assembled and movably attached to an otherwise completed cartridge.

In addition to being embodied in the five preferred embodiments disclosed above, the present invention also encompasses a preferred embodiment in which disposable cartridges are releasably joined in modular fashion to allow easy stacking, arrangement, and replacement of the cartridges. In accordance with the preferred embodiment of the apparatus of the present invention, the cartridges disclosed in one or more of the first five preferred embodiments of the apparatus of the present invention are fitted with joining means including, but not limited to hook and loop fasteners (such as Velcro™ strips), at strategic locations around the outside edges of the cartridge formed by the meeting of the top, bottom, and sides of the cartridges. Each joining means laps over the outside edge and occupies a small area on both of the two surfaces (top and side, or bottom and side) that meet to form the edge where the joining means is affixed to the cartridge. Additionally, the apparatus of the preferred embodiment of the present invention includes stabilizers fitted with the same joining means at strategic locations. The stabilizers work in conjunction with the cartridges to form a modular product display and serve to provide additional structural support. Furthermore, the stabilizers aid in preventing slippage of the modular product display on a store counter.

In accordance with a preferred method of the preferred embodiment of the present invention, a number of product display cartridges having the same height are aligned side by side and are then pressed together to cause engagement of the joining means. The result is a row of cartridges that contain a variety of different products and have a variety of different inventive features. Using this method, other rows are formed and then joined to each other by stacking the rows on top of one another to engage the joining means. Preferably, the stabilizers are joined to the outer most cartridges to complete the modular product display. This "building block" approach allows a store owner or manager to replace an empty cartridge by simply pulling apart the modular display, replacing the empty cartridge, and then reassembling the modular display. The same method is used if the store owner or manager wishes to rearrange the display cartridges in a different pattern to achieve improved space utilization on a checkout counter.

Accordingly, it is an object of the present invention for product displays to be lightweight, yet have sufficient structural rigidity to be self-supporting.

Another object of the present invention is to allow product displays to be disposed of when empty.

Still another object of the present invention is to minimize the amount of space required by an individual product display.

Still another object of the present invention is to minimize the amount of product stored by an individual product display.

Still another object of the present invention is to maximize the number of locations and orientations in which a product display can be positioned.

Still another object of the present invention is to improve customer access to products dispensed by a product display.

Still another object of the present invention is to enable the display and dispensing of a wide variety of products of different sizes, shapes, and packaging.

Still another object of the present invention is to enhance product display replacement.

Still another object of the present invention is to make product replinishment non-dependent upon a route person.

Still another object of the present invention is to make possible the display and dispensing of products at low cost.

Still another object of the present invention is to enable multiple product displays to be releasably joined together so that they can be easily arranged and oriented in different patterns at will to improve space utilization and aesthetic appearance.

Other objects, features, and advantages of the present invention will become apparent upon reading and understanding the present specification, with the referenced patent specification, when taken in conjunction with the appended drawings.

DETAILED DESCRIPTION OF THE DRAWINGS

Figure 1:
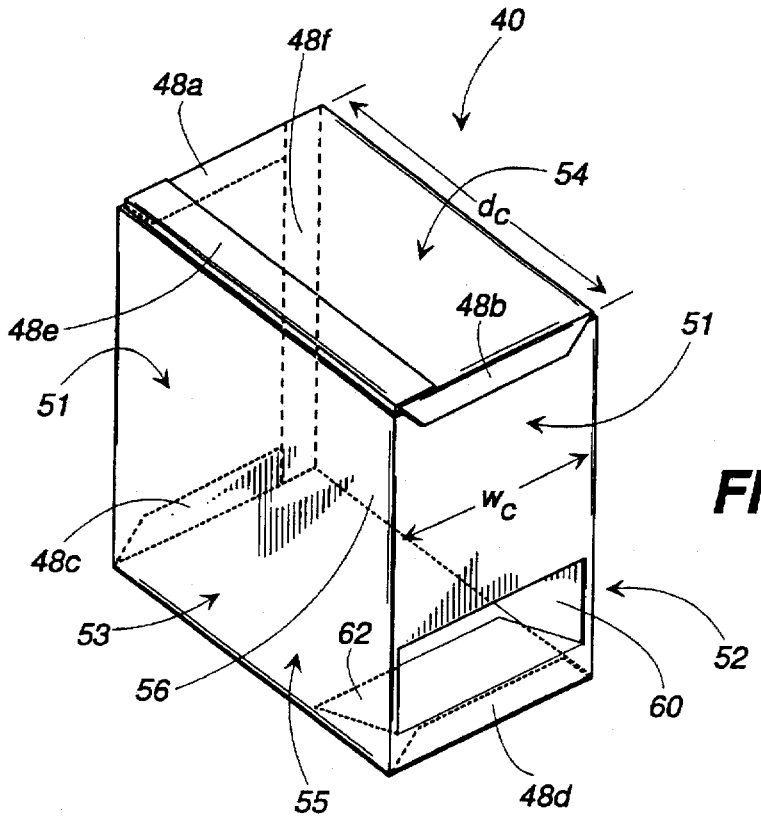
FIG. 1 is a side, perspective view of the assembled cartridge apparatus in accordance with a first preferred embodiment of the present invention.
Figure 2:
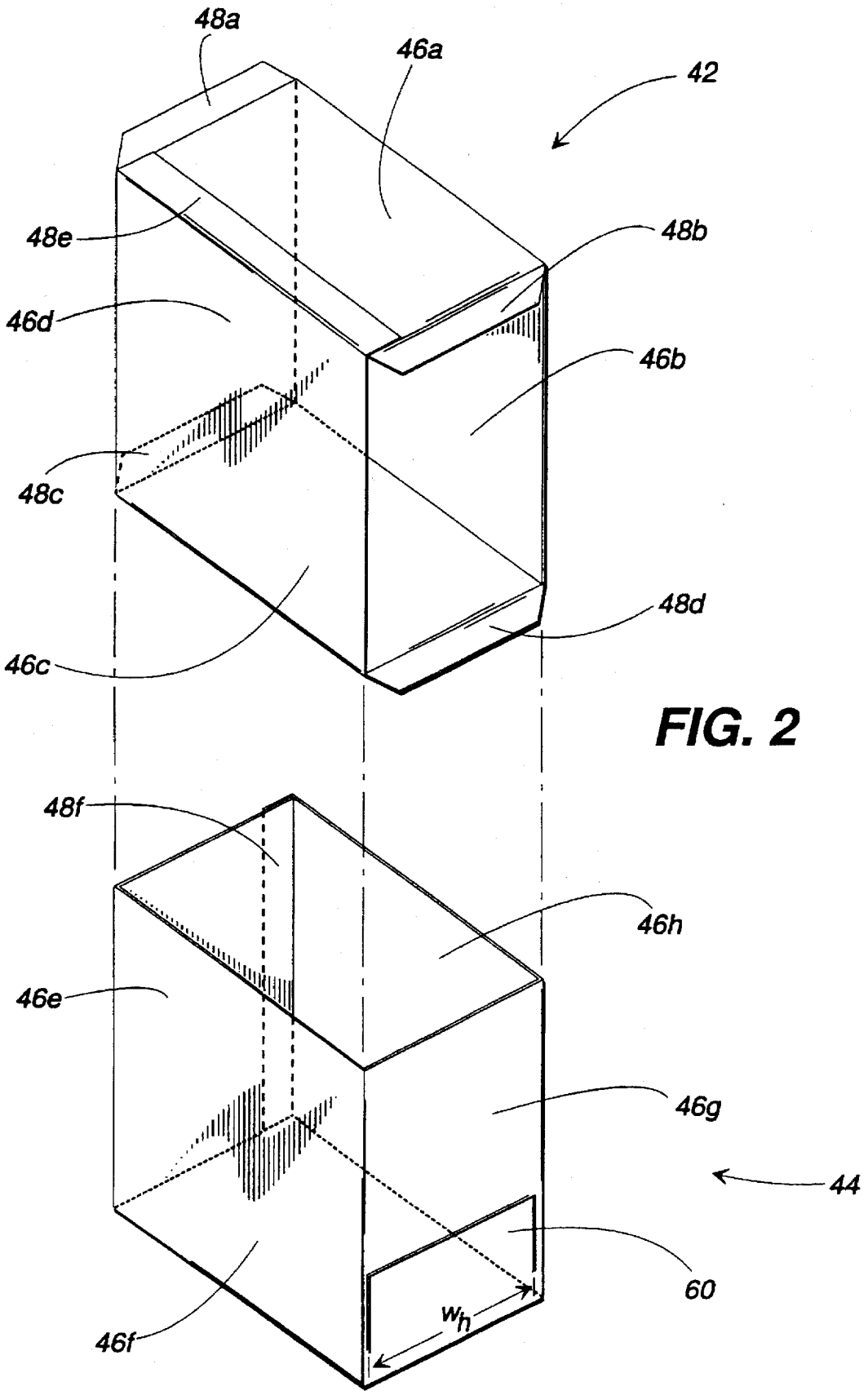
FIG. 2 is an exploded, side, perspective view of the assembled cartridge apparatus of FIG. 1.

Referring now in greater detail to the drawings, in which like numerals represent like components throughout the several views, FIG. 1 displays a side, perspective view of an assembled, disposable cartridge apparatus 40 for displaying and dispensing large, individually wrapped, product to consumers, in accordance with the present invention. The disposable cartridge 40, in accordance with a first preferred embodiment of the apparatus of the present invention, is inventively formed by two elongated, rectangular sleeves 42, 44 (FIG. 2) positioned with the first sleeve 42 (FIG. 2) residing inside the second sleeve 44 (FIG. 2). For clarity, the sleeves 42, 44 are shown separated from one another in the exploded view of FIG. 2. Also, to improve clarity, no product is shown in FIGS. 1 and 2. The four panels 46 of the first, inner sleeve 42 are oriented so that, upon final assembly, panels 46*a,b,c,d* become a top 54, right side 52, bottom 55, and left side 53, respectively, for the assembled cartridge 40 of FIG. 1. Since the inner sleeve 42 has only four panels 46, it does not provide a front 50 or back 51 for the cartridge 40. To resolve this shortcoming, the second, outer sleeve 44 of FIG. 2 is cleverly rotated relative to the inner sleeve 42 so that panel 46*g* becomes the front 50 and panel 46*e* becomes the back 51 of the assembled cartridge 40. Of tenting the sleeves 42, 44 relative to one another in this manner also defines an enclosed cavity 56 in which the product is held for removal and impulse purchase by a consumer. In addition, the orientation of the sleeves 42, 44 causes panels 46*b,d* of the inner sleeve to be adjacent to panels 46*h,f* of the outer sleeve, thereby effectively doubling the thickness of the right side 52 and left side 53 of the cartridge 40. As a result, the structural rigidity of the cartridge 40 is improved and hence, the self-supporting capability of the cartridge 40 is enhanced.

Figure 4:
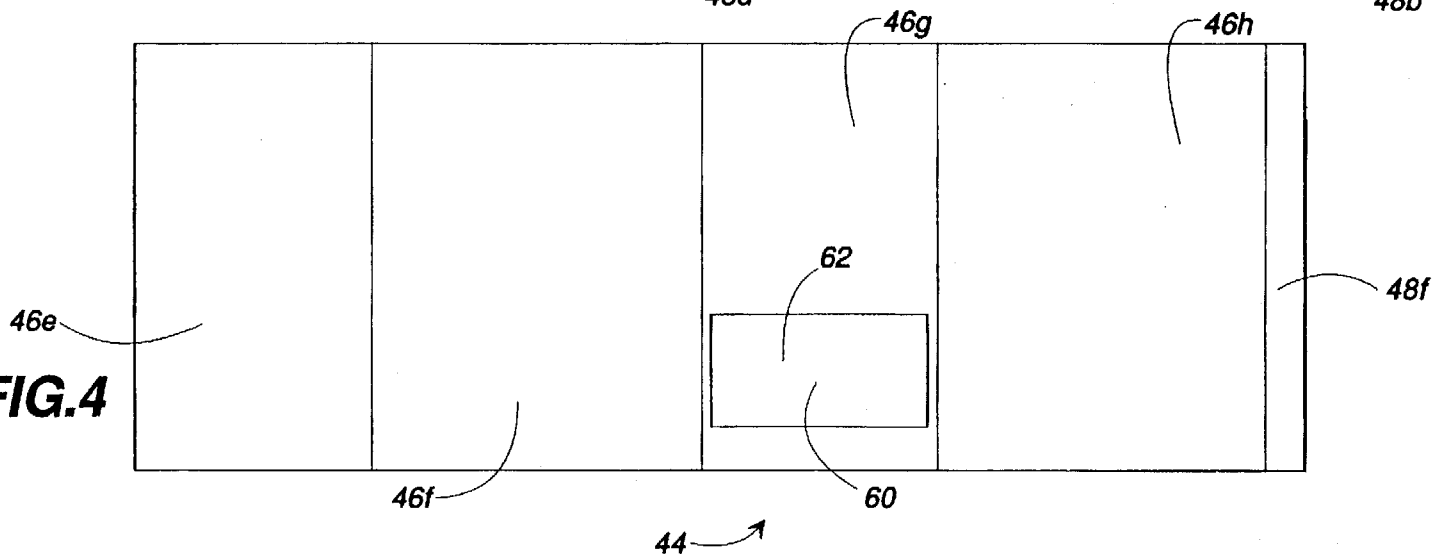
FIG. 4 is a flat pattern view of the outer sleeve of the assembled cartridge apparatus of FIG. 1.

The disposable cartridge 40 of FIG. 1, in accordance with the first preferred embodiment of the apparatus of the present invention, also includes a rectangular shaped access port 60 in the front 50 through which customers reach to remove product. As shown in FIGS. 2 and 4, the access port 60 is actually cut through panel 46*g* of the outer sleeve 44 and becomes located on the front 50 of the assembled cartridge 40 of FIG. 1 due to the relative orientation of the sleeves 42, 44. In one preferred use, the cartridge cavity 56 contains thin, flexible, product packets (see packets 66 in cartridge 40 of FIG. 22) stacked one on top of the other. As a customer removes a packet 66 from the cartridge 40, the other packets are fed by gravity from the top 54 to the bottom 55 of the cartridge 40. Therefore, the access port 60 is strategically positioned in the panel 46*g* to take advantage of the movement of the packets 66 and, thereby, insure that a product packet is always available to a consumer.

In the embodiment specifically constructed for use with the thin flat packets 66, the size and shape of the access port 60 are governed by a number of factors. First, the size and rectangular shape of the access port 60 maximizes the amount of space available for packet 66 selection and grasping by the consumer while minimizing the loss of structural rigidity due to material removal from the front 50 of the cartridge 40. Second, the width, $w_h$, of the access port 60 is sized to allow easy removal of the packets by consumers while preventing the packets from falling out of the cartridge 40. In typical use, the cartridge cavity 56 contains product packets 66 having width and depth dimensions that closely approach the width, $w_c$, and depth, $d_c$, dimensions of the cavity 56. By making the width, $w_h$, of the access port 60 slightly smaller than the width, $w_c$, of the cavity 56 (and, hence slightly smaller than the packet width), the flexible packets 66 deflect slightly as they are pulled through the access hole 56 by a consumer, but do not fall out of the cartridge 40 when left alone. Third, the material removed for the rectangular shaped port60 creates a rectangular shaped ramp 62 as discussed below.

Referring back to FIG. 1, the material displaced to make the access port 60 forms a rectangular shaped ramp 62 that extends downwardly into the cavity 56 of the cartridge 40. The ramp 62 works in conjunction with the access port 60 to aid in the removal of product packets by consumers. More specifically, the ramp 62 extends almost across the entire width, $w_c$, of the cavity 56 and supports the packets to maintain uniform stacking of the packets within the cavity 56. Otherwise, the packets could become jammed, thereby making packet removal difficult for a customer. The ramp 62 also funnels the product packets toward the Access port 60 and enables the customer to remove an individual packet from the cavity 56 by applying slight downward pressure to the packet while sliding it upward along the ramp 62. In addition, when only a small number of packets remain in the cartridge 40, the ramp 62 prevents the packets from getting hung up in the portion of the cavity 56 below the level of the access port 60 and, as a result, makes it easier to remove the last few packets from the cartridge 40.

Figure 3:
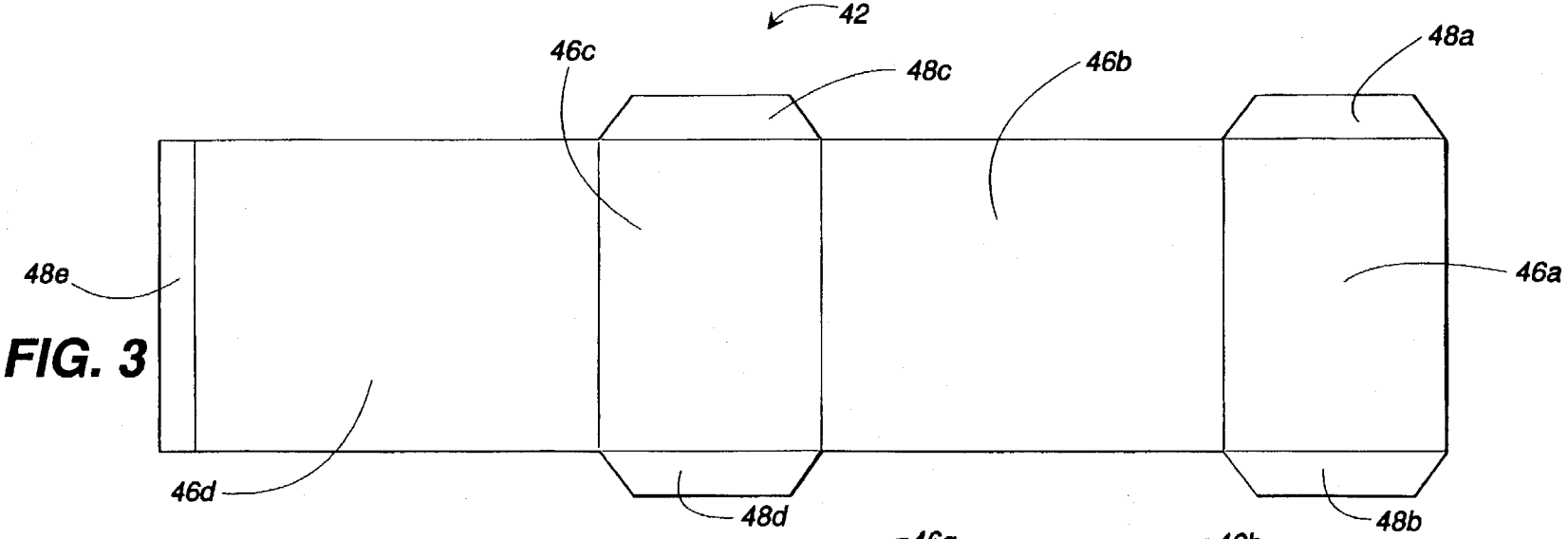
FIG. 3 is a flat pattern view of the inner sleeve of the assembled cartridge apparatus of FIG. 1.

In accordance with a preferred method of manufacture of the first preferred embodiment of the present invention, the inner sleeve 42 and outer sleeve 44 are uniquely designed and carefully patterned in concert with one another as a series of panels 46 and flaps 48 displayed by the flat patterns of FIGS. 3 and 4, respectively. In these figures, cut lines are depicted by lines of heavier weight than those that define fold lines. Cut lines define the general shape of the sleeves 42, 44 and partially define the rectangular shaped access port 60 in the outer sleeve 44. The remainder of the access port 60 (in this case, the bottom edge) is defined by a fold line. The access port 60 is cleverly patterned in this way to create the ramp 62 by folding the material initially occupying the access port 60 into the cartridge 40 during the assembly process.

Following the cut lines of the patterns, the sleeves 42, 44 are cut from a flat sheet of material that is lightweight, flexible, and has sufficient structural stiffness to enable the finished cartridge 40 to be self-supporting. Note that it is the assembled cartridge 40 that must be self-supporting and not each individual sleeve 42, 44. Preferably, the sleeves are cut from flat sheets of thin plastic. Note also that a variety of plastics or other materials meet these criteria and that a variety of methods may be employed to cut these materials, including, for example, die cutting in a punch press. The use of die cutting allows the cut lines of the access port 60 to be cut when the sleeves 42, 44 are cut from the flat sheet of material. In addition, the use die cutting allows the fold lines to be scored during the cutting operation. Otherwise, the cut lines are cut and the fold lines scored in subsequent, separate steps.

With the sleeves 42, 44 laying flat after cutting and scoring as seen in FIGS. 3 and 4, the flaps 48 are pre-folded along their respective fold lines into a, generally, upward direction. Pre-folding the flaps 48 at this stage assembly is preferred, though not required, since it typically improves the ease and quality of later final folding operations. The sleeves 42, 44 are then given their elongated rectangular shape by folding the panels 46 into position along the fold lines between panels 46 to produce the inner sleeve 42 and outer sleeve 44 shown in FIG. 2. To prevent the resiliency and springing of the plastic from unfolding the sleeves 42, 44, flaps 48*e,f* are properly joined and secured, for example, by taping to the outside of panels 46*a,e*, respectively. Note that it is preferred, though not required, to tape the flaps 48*e,f* to the outside of panels 146*a, e* since, if the flaps 48*e,f* are joined to the inside of panels 46*a,e* rather than to the outside, the sleeves 42, 44 do not attain a truly rectangular shape and as a result, do not properly allow the inner sleeve 42 to reside within the outer sleeve 44. In addition, iron the inside, the flaps 48*e,f* interfere with the orderly stacking of packets within the cavity 56 and hence, make removal of packets from the cartridge 40 less than preferred.

Once assembly of the sleeves 42, 44 is completed, the inner sleeve 42 is filled, in accordance with a preferred method of the first preferred embodiment of the present invention, with product (such as packets 66) for ultimate sale to consumers. Note that FIGS. 1 and 2 display inner sleeve 42 with flap 48*e* positioned on the top 54 of the cartridge 40. However, in accordance with a preferred method, the inner sleeve 42 is rotated so that flap 48*e* is positioned on the bottom 55 of the cartridge 40 to improve the cartridge's aesthetic appearance. After filling the inner sleeve 42 with packets, it is positioned above the outer sleeve 44 and is slid downward, into the outer sleeve 44. When correctly positioned, only the flaps 48*a,b,c,d* extend above and below the cartridge 40. The sleeves 42, 44 are then interlocked together by a series of steps that secures the flaps 48*a,b,c,d* in their final positions. First, pre-folded flaps 48*a, b* of the inner sleeve 42 are final folded downward over the outer sleeve 44 and secured, for example, by taping to panels 46*e,g*, respectively. Second, pre-folded flap 48*c* of the inner sleeve 42 is final folded upward over the outer sleeve 44 and secured, for example, by taping to panel 46*e*. Third, pre-folded flap 48*d* of the inner sleeve 42 is final folded upward and inside panel 46*g* of the outer sleeve 44, but is not secured in place. Instead, upward movement of flap 48*c* and hence, the inner sleeve 42, is prevented by the ramp 62, while downward movement of the inner sleeve 42 is prevented by the secured flaps 48*a,b,c*. After interlocking the two sleeves 42, 44, the ramp 62 is created by folding the material in the access port 60 downward and into the cavity 56 so that the ramp 62 resides under the product packet closest to the bottom 55 of the cartridge 40. With assembly of the cartridge 40 complete, the cartridge 40 is ready for use.

In the remainder of the discussion of the drawings that follows, a number of different, preferred embodiments are disclosed in which the cartridges have specific inventive features, but are based upon the novel two sleeve design and assembly disclosed in the first preferred embodiment of the present invention. As a result, the apparatus and methods of the preferred embodiments that follow are similar in many respects to those of the first preferred embodiment. For instance, with regard to the apparatus of the preferred embodiments, each cartridge has an inner sleeve that is rotated relative to and inserted into an outer sleeve. Each cartridge also has an access hole through which customers reach to remove product. In turn, each sleeve has four panels and a number of flaps that are used to form the sleeve and to interlock the sleeve during final assembly. With regard to the preferred methods of manufacture of the preferred embodiments, the sleeves and flaps of the cartridges are patterned, cut, scored, folded, inserted, and secured using, for the most part, the same method as that employed in the preferred method of the first preferred embodiment. Furthermore, the selection of a material for the cartridge elements in the preferred embodiments that follow is based upon similar criteria as that utilized in making a material selection for the elements disclosed in the first preferred embodiment. Therefore, to avoid unnecessary duplication in the discussion of the drawings that follows, the cartridges of the preferred embodiments should be understood to have the same basic two sleeve design as that of the apparatus of the first preferred embodiment. In addition, the cartridges should be understood to have the same basic method of construction and assembly. Also, any inserts or additional cartridge elements should be understood to be fabricated by a method similar to that used to fabricate the cartridges. Where differences exist in either the apparatus or methods, they are noted and described appropriately.

Figure 5:
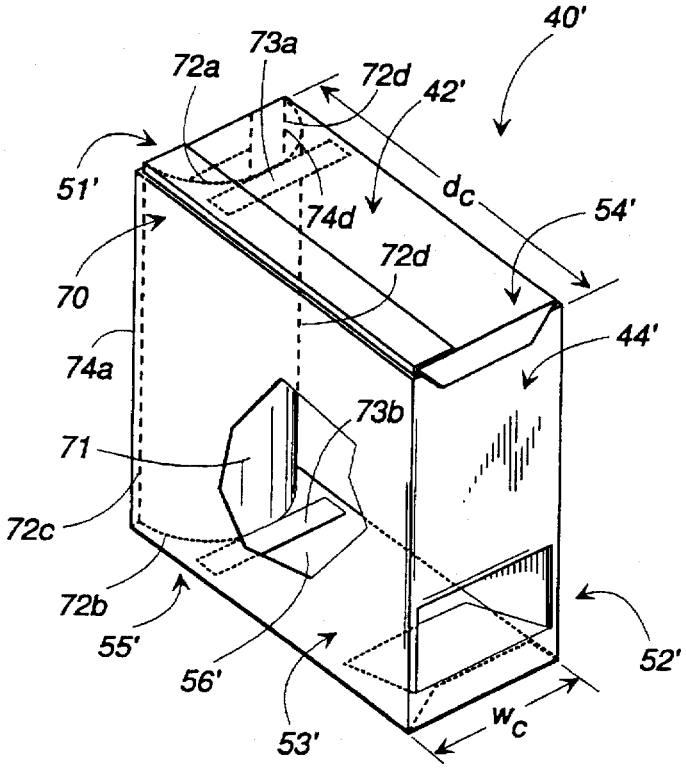
FIG. 5 is a side, perspective view of the assembled cartridge apparatus in accordance with a second preferred embodiment of the present invention.

A second preferred embodiment of the apparatus of the present invention displayed in FIG. 5, includes an inventive false back insert 70 positioned within the cavity 56' defined by the two interlocking sleeves 42', 44' of the present invention. Use of the false back insert 70 allows products in packets (not shown) smaller than those allowed by the apparatus of the first preferred embodiment to be displayed and dispensed, while still maintaining the same cartridge 40 depth, $d_c$, and inventive features disclosed in the apparatus of the first preferred embodiment. The false back insert 70 consumes space not required by the smaller packets and forces the packets to reside in the remainder of the cavity 56' by protruding a panel 71 into the cavity 56' from the back 51' of the cartridge 40'. The panel 71 extends from the top 54' to the bottom 55' of the cartridge 40' with an edge 72*a* residing against the top 54' and an edge 72*b* residing against the bottom 55'. Attached to each edge 72*a,b*, is a flap 73 that prevents packets from slipping by the edges 72*a,b* and becoming lodged between the panel 71 and the top 54' and bottom 55' of the cartridge 40'. The flaps 73 extend for a distance across the width, $w_c$, of the cavity 56' and are sized to provide sufficient blocking of the packets. Flap 73*a* rests against the top 54' of the cartridge 40', while flap 73*b* rests against the bottom 55' of the cartridge 40'.

The generally, arc-shaped protrusion of panel 71 seen in FIG. 5 is created upon assembly by a combination of factors. First, the width, $w_{fb}$, of the false back insert 70 (see FIG. 6) is greater than the width, $w_c$, of the cavity 56'. Second, when inserted into the cavity 56' during assembly, edges 72*c,d* of the false back insert 70 reside in corners 74*a,b*, respectively, formed by the fight side 52', left side 53', and back 51' of the cartridge 40'. Third, the false back insert 70 is manufactured from a flexible material such as plastic. Thus, upon insertion of the false back insert 70 into the cavity 56', these factors combine to force panel 71 to spring outward and protrude into the cavity 56' since it cannot spring and protrude in any other direction. The amount of protrusion is determined by the difference in the widths of the false back insert 70 and the cavity 56'. Greater differences are utilized to increase protrusion and thereby, enable the cartridge 40' to display and dispense smaller packets. Lesser differences are utilized to decrease protrusion and thereby, enable the cartridge 40' to display and dispense larger packets.

Figure 6:
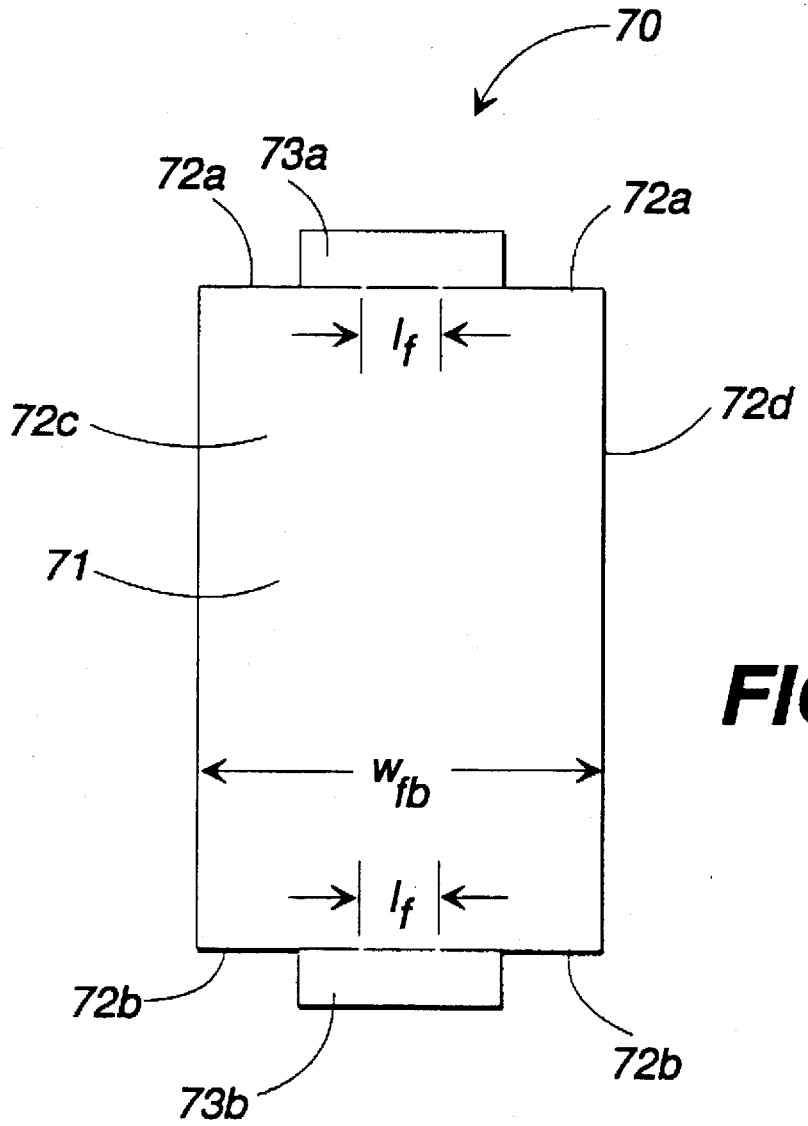
FIG. 6 is a flat pattern view of the false back insert of the assembled cartridge apparatus of FIG. 5.

In accordance with a preferred method of the second preferred embodiment of the present invention, the cartridge 40' is designed and assembled, for the most part, as disclosed in the preferred method of the first preferred embodiment of the present invention. However, in the current method, the false back insert 70 of FIGS. 5 and 6 is designed and patterned with flaps 73 similar to those of sleeves 42', 44'. FIG. 6 displays the flat pattern of the false back insert 70 and as in FIGS. 3 and 4 described above, the heavier weight lines indicate cut lines and the lighter weight lines indicate fold lines. Note that FIG. 6 shows fold lines between flaps 73*a,b* and panel 71. The length, 1*f*, of the fold lines is set to allow the panel 71 to achieve the desired protrusion into the cavity 56' while retaining enough attachment between the panel 71 and flaps 73 to prevent the flaps 73 from breaking off easily.

After assembling the individual sleeves 42', 44', but before insertion of the inner sleeve 42' into the outer sleeve 44', the false back insert 70 is cut and scored, for example, by die cutting from the same material as that of the sleeves 42', 44' (or from a different material having the same general properties as the material of the sleeves 42', 44'. In accordance with this preferred method of the second preferred embodiment of the present invention, the flaps 73 of the false back insert 70 are folded upward so that each remains approximately at a 90 degree angle to the panel 71. The false back insert 70 is then positioned inside the inner sleeve 42' with the flaps 73 situated as shown in FIG. 5. Product packets are placed into the inner sleeve 42' so that they press against the protruding panel 71 of the false back insert 70. From this point on, the remainder of the assembly of cartridge 40' parallels the preferred method of the first preferred embodiment of the present invention until the cartridge 40' is completely assembled.

Figure 7:
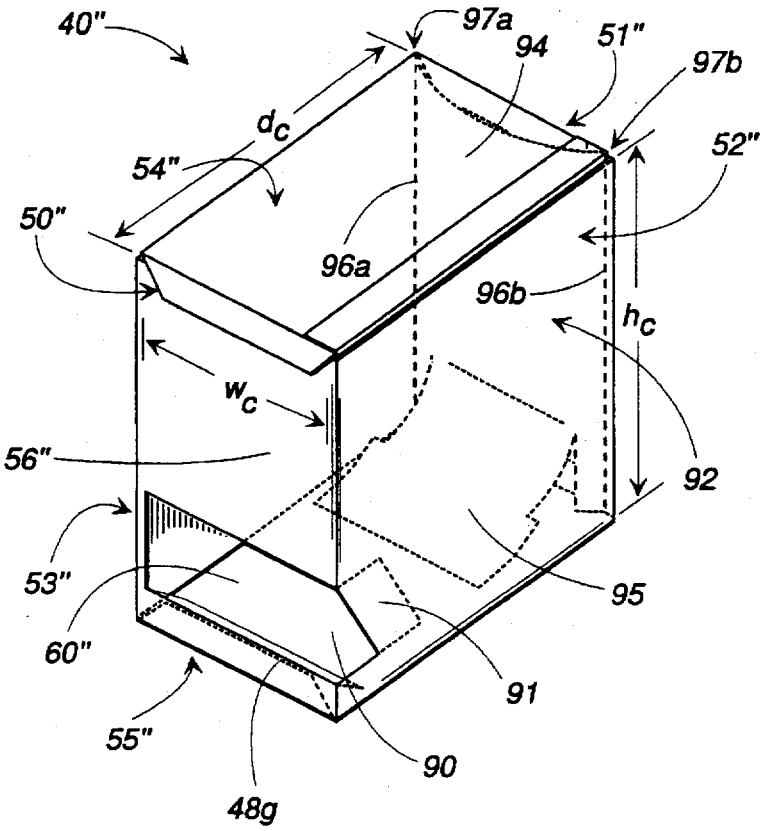
FIG. 7 is a side, perspective view of the assembled cartridge apparatus in accordance with a third preferred embodiment of the present invention.

A third preferred embodiment of the apparatus of the present invention displayed by FIG. 7 includes the basic, two sleeve cartridge 40 of the first preferred embodiment, but adds a side slit 90 and a back bottle ramp 92 to enable the cartridge 40" to display and dispense small, cylindrical shaped bottles (not shown to enhance clarity). When a customer reaches for a bottle, the side slit 90 exposes the top of the next available bottle and allows the customer to place a finger through the slid slit 90 and onto the top of the bottle making it easier to grasp and remove the bottle from the cartridge 40". The side slit 90 is utilized on the right side 52" of the cartridge 40" rather than the left side 53" for, at least, two reasons. First, the majority of humans are right-handed and most often remove bottles from the cartridge 40" using the cooperation between their right index finger and thumb. Second, slitting both sides 52", 53" of the cartridge 40" weakens the structural rigidity of the cartridge 40" more than necessary. The size and shape of the side slit 90 is a compromise between the loss of structural rigidity, the size of the bottles being dispensed, and the average size of the end of a human index finger. Thus, a goal in deciding upon a size and shape is to minimize the loss of structural rigidity while enabling quick and easy removal of the bottles by a customer. To aid in minimizing the loss of structural rigidity due to the side slit 90, FIG. 7 also shows a side slit flap 91 that restores some of the lost structural rigidity by being folded back against the inside of the cartridge's right side 52".

As mentioned above, the third preferred embodiment of the apparatus of the present invention includes a uniquely designed back bottle ramp 92 that is illustrated in FIG. 7 and located at the back 51" of the cartridge 40". The figure shows the back bottle ramp 92 extending from the top 54" to the bottom 55" of the cartridge 40" and having an upper portion 94, a lower portion 95, and edges 96 (also see FIGS. 8 and 11). The upper portion 94 of the back bottle ramp 92 protrudes into the cavity 56" of the cartridge 40" similarly to the false back insert 70 of the second preferred embodiment of the apparatus of the present invention. This generally, arc-shaped protrusion serves to fill excess space in the cartridge cavity 56", thereby allowing the depth, $d_c$, of the cartridge 40" to match the depth, $d_c$, of the cartridges 40, 40' in the previous preferred embodiments. Like the false back insert 70, the protrusion of the upper portion 94 of the back bottle ramp 92 occurs because the width, $w^{up}$ of the upper portion 94 (see FIG. 11 ) is wider than the width, $w_c$, of the cavity 56" of the cartridge 40" and because edges 96*a,b* reside in corners 97*a,b*, respectively, forcing the material of the upper portion 94 to bow toward the front 50" of the cartridge 40". Also like the false back insert 70, the amount of protrusion is determined by the difference in the widths of the upper portion 94 and the cavity 56". Greater differences are utilized to increase protrusion and thereby, enable the cartridge 40" to display and dispense slightly smaller bottles. Lesser differences are utilized to decrease protrusion and thereby, enable the cartridge 40" to display and dispense slightly larger bottles.

In accordance with the third preferred embodiment of the apparatus of the present invention, FIG. 7 displays the lower portion 94 of the back bottle ramp 92 as it extends downward and curves forward before contacting the bottom 55" of the cartridge 40". In doing so, the lower portion 94 of the back bottle ramp 92 naturally guides the remaining bottles toward the front 50" of the cartridge 40" when another bottle is removed by a consumer through the access port 60" that works in cooperation with the side slit 90. The lower portion 94 of the back bottle ramp 92 is sized and shaped to provide maximum support for the bottles and to prevent jamming as the bottles roll down the back bottle ramp 92.

Still referring to FIG. 7, the access port 60" is positioned in the front 50" and near the bottom 55" of the cartridge 40" to enable the bottles to be removed from the cartridge 40". As in the first preferred embodiment described above, the size and shape of the access port 60" in the cartridge 40" is governed by a number of factors, but is dimensionally more critical because bottles do not flex like packets during removal from the cartridge 40". Therefore, the size and shape of the access port 60" is primarily dependent upon the size and shape of the bottles being dispensed. Since the bottles must pass through the access port 60' and have, basically, a rectangular cross-section, the access port 60" is sized slightly larger than and shaped to match their cross-section. In addition, the access port 60" is sized and shaped to work in conjunction with the side slit 90 to maximize the ease of bottle grasping and removal by consumers while minimizing the loss of structural rigidity due to material removal from the front 50" of the cartridge 40".

FIG. 7 also displays a small flap 48*g* that is formed from a portion of the material removed to create the access port 60'. The flap 48*g* extends at a steep angle downward into the cavity 56" and is sized to barely contact the bottom 55" of the cartridge 40". The steepness of the flap 48*g* causes the flap 48*g* to act as a stop that helps to prevent the bottles from rolling out of the cartridge 40" on their own. The flap 48*g* also provides an interlocking mechanism to hinder separation of the inner and outer sleeves 42", 44" after final assembly.

Figure 8:
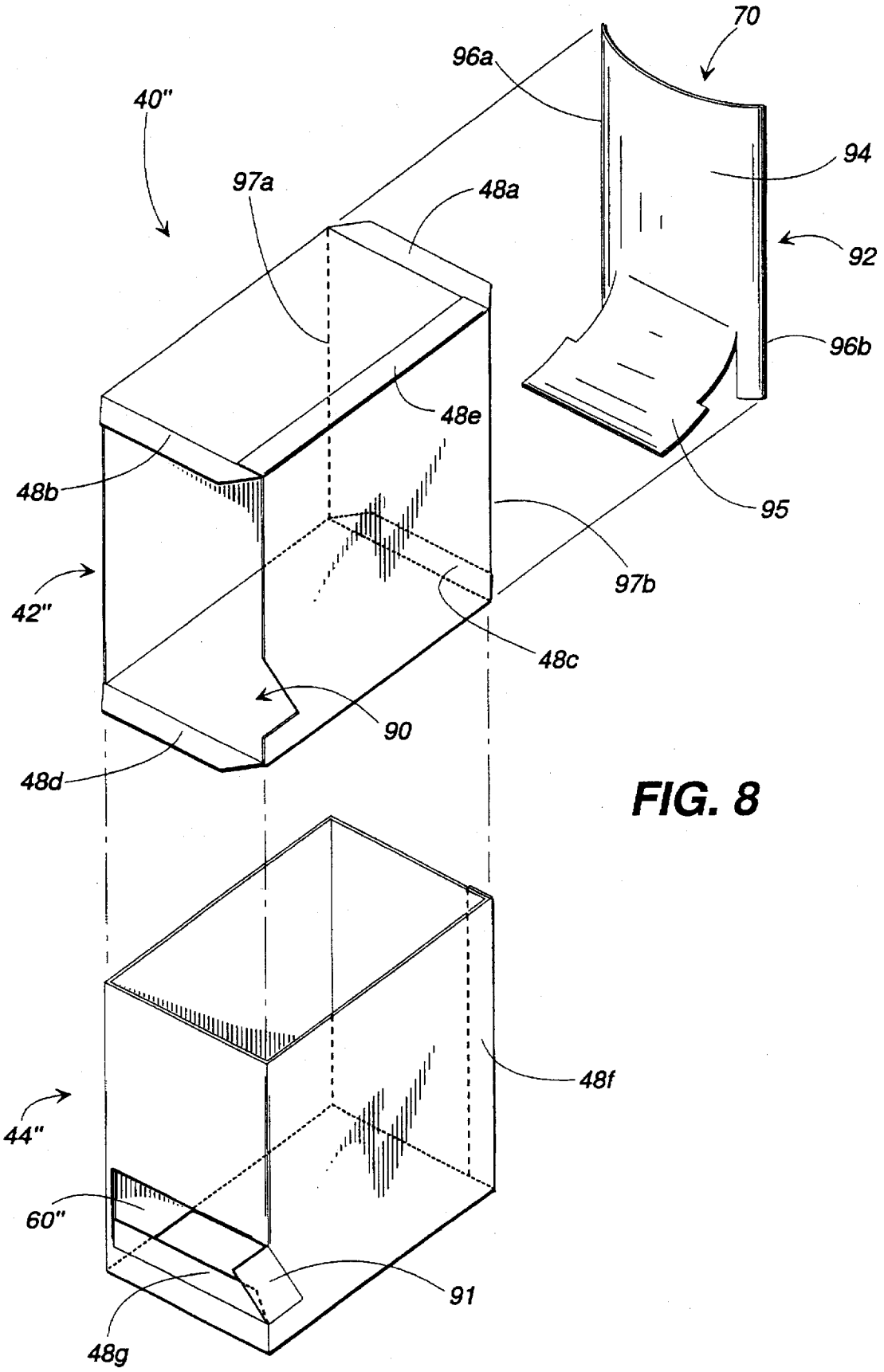
FIG. 8 is an exploded, side, perspective view of the assembled cartridge apparatus of FIG. 7.

In accordance with a preferred method of the third embodiment of the present invention, the flat patterns of inner sleeve 42" and outer sleeve 44" of the cartridge 40", shown in the exploded view of FIG. 8, have several important pattern changes from those of the sleeves 42, 44 of the first preferred embodiment of the present invention. The pattern changes are readily apparent by a comparison of FIG. 8 to FIG. 2. In particular, FIG. 8 shows the side slit 90 in the inner sleeve 42" and the side slit flap 91 in the outer sleeve 44". Additionally, a comparison of the figures illustrates that ramp 62 of the first preferred embodiment has been eliminated in favor of the flap 48*g* in the outer sleeve 44"

Figure 9:
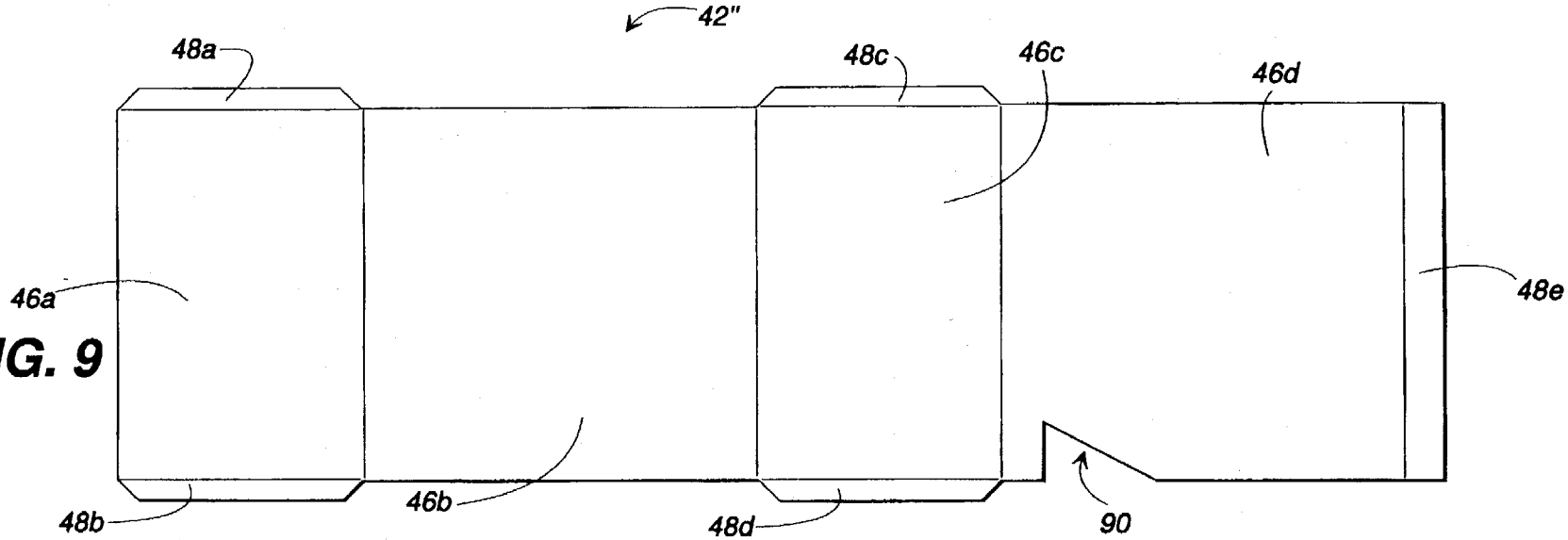
FIG. 9 is a flat pattern view of the inner sleeve of the assembled cartridge apparatus of FIG. 7.
Figure 10:
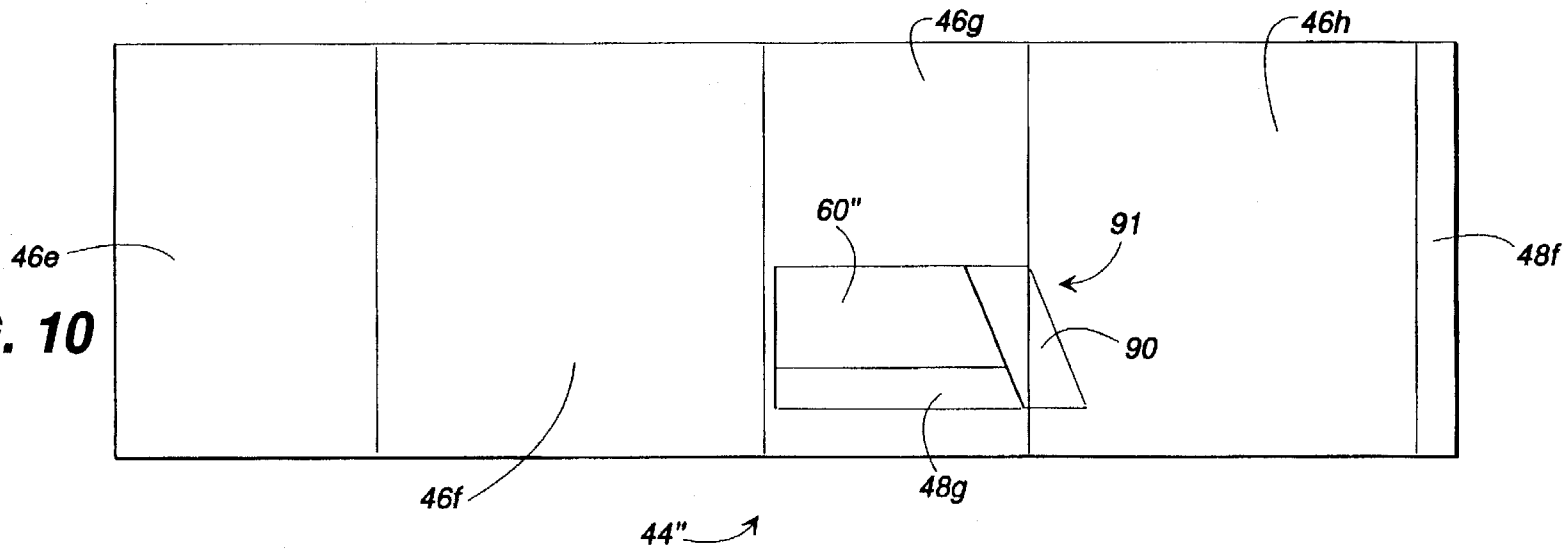
FIG. 10 is a flat pattern view of the outer sleeve of the assembled cartridge apparatus of FIG. 7.

The effect of the pattern changes is manifested in FIGS. 9 and 10 which illustrate the flat patterns for the inner sleeve 42" and outer sleeve 44', respectively. In these figures, the heavier weight lines indicate cut lines and the lighter weight lines indicate fold lines. From a design perspective, the creation of the side slit 90 is, at least, a two step process. First, a generally, triangular shaped section the same size as the side slit 90 is designated for removal from panel 46*d* of the inner sleeve 42". Second, the same size and shape section is designated from panel 46*h* as a part of the side slit flap 91 that folds into the cavity 56", upon assembly, to strengthen the region around the side slit 90. Note that the generally, triangular shaped section is identical in size in both sleeves 42", 44" because both sleeves 42", 44" contribute a right side 52" to the assembled cartridge 40".

Otherwise, the side slit flap 91 cannot fold properly over the inner sleeve 42" and into its proper position inside the cavity 56". FIG. 10 also shows, in comparision to FIG. 4, that the size of the access port 60" has been increased to accommodate the bottles.

Figure 11:
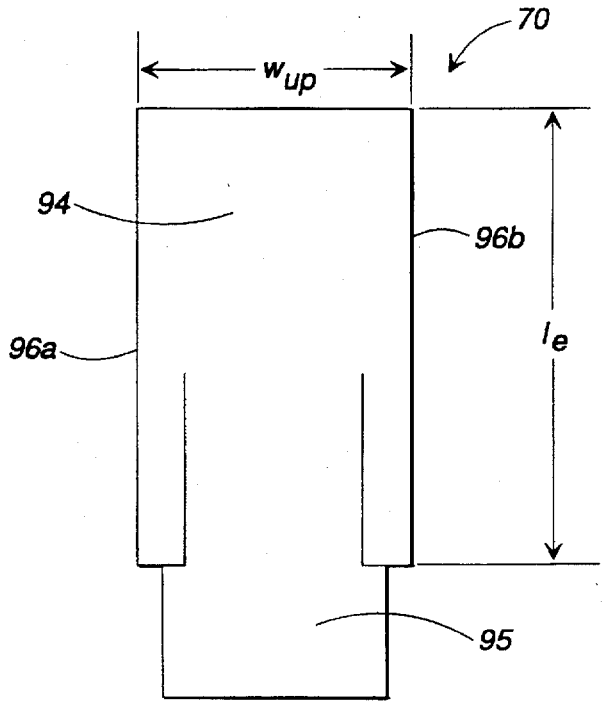
FIG. 11 is a flat pattern view of the back bottle ramp insert of the assembled cartridge apparatus of FIG. 7.

Unlike the side slit 90, the back bottle ramp 92 required no changes to the sleeves 42", 44" and is, instead, a separate insert that is designed and patterned using techniques similar to those used for the sleeves 42", 44". FIG. 11 displays a flat pattern view of the back bottle ramp 92. In the figure, all lines indicate cut lines and no fold lines are shown. However, it is important to note that a slight amount of bending occurs, upon assembly, where the upper portion 94 and the lower portion 95 meet. The bending is necessary to allow the lower portion 95 to flex forward into the cavity 56" and to contact the bottom 55" of the cartridge 40" as seen in FIG. 7. It is also important to note that the length, $1c$, of the edges 96*a,b* is the same as the height, $h_c$, of the cavity 56" (see FIG. 7), thereby enabling the edges 96*a,b* to extend from the top 54" to the bottom 55" of the cavity 56".

In accordance with a preferred method of the third preferred embodiment of the present invention, the inner and outer sleeves 42", 44" are cut, for example, by die cutting from a lightweight, flexible material such as plastic, by using the patterns of FIGS. 9 and 10. After assembling the individual sleeves 42", 44", but before insertion of the inner sleeve 42' into the outer sleeve 44', the back bottle ramp 92 is cut, for example, by die cutting from the same material as that of the sleeves 42", 44" (or From a different material having the same general properties as the material of the sleeves 42", 44"). In accordance with the preferred method of the third preferred embodiment of the present invention, the back bottle ramp 92 is positioned inside the inner sleeve 42" as shown in FIG. 7. Product bottles are then stacked into the inner sleeve 42" on top of one another. Some of the bottles rest on top of the lower portion 95 of the back bottle ramp 92 while others rest against the upper portion 94. The inner sleeve 42" containing the bottles is next inserted into the outer sleeve 44" and the side slit flap 91 is folded into the cavity 56". Assembly is completed by folding the flap 48*g* over the inner sleeve 42" and downward into the cavity 56".

Figure 12:
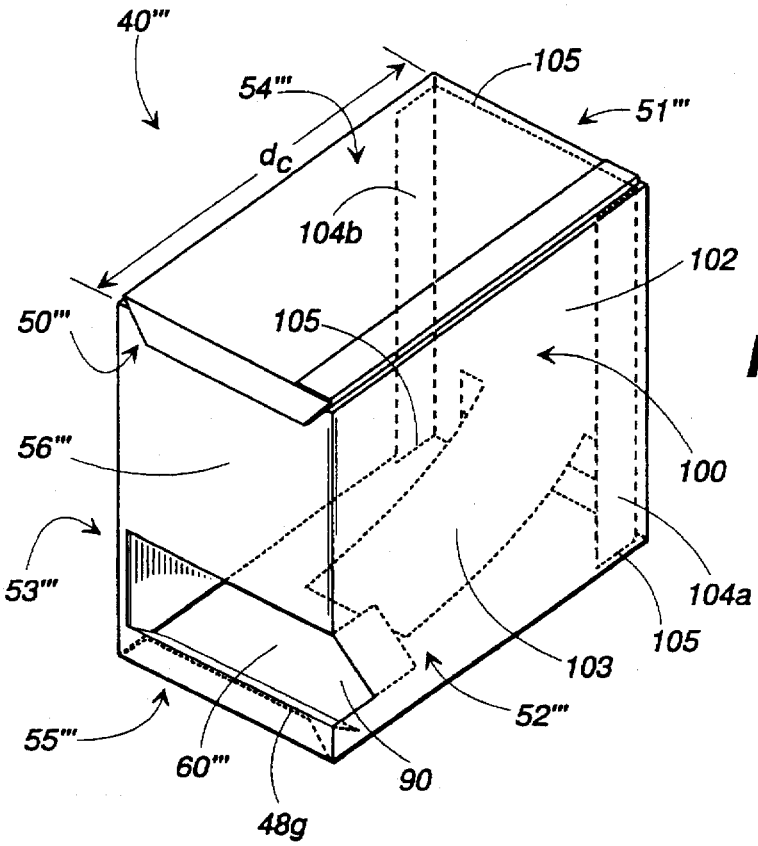
FIG. 12 is a side, perspective view of the assembled cartridge apparatus in accordance with a fourth preferred embodiment of the present invention.

A fourth preferred embodiment of the apparatus of the present invention is displayed in FIG. 12 and is very similar to the third preferred embodiment of the apparatus of the present invention disclosed above. The cavity 56'" has a greater depth, $d_c$, to accommodate larger, cylindrical shaped bottles and a back bottle ramp 100 that does not bow into the cavity 56'". Instead, the back bottle ramp 100 is designed to fit snugly inside the back 51'" of the cartridge 40'" and to provide a steeper ramp to allow the larger, heavier bottles to more easily feed via gravity toward the front 50'" of the cartridge 40'". The back bottle ramp 100 is sized so that its edges 105 touch the top 54'" and bottom 55'" of the cartridge 40'". The back bottle ramp 100 includes an upper portion 102 that rests against the outer sleeve 44'" of the cartridge 40'" and a lower portion 103 that extends downward and forward before coming into contact with the bottom 55'" of the cartridge 40'" In addition, the back bottle ramp 100 has flaps 104*a, b* that rest against the right side 52'" and left side 53'", respectively, and serve to maintain the position of the ramp 100 while adding structural rigidity to the cartridge 40'".

As shown in FIG. 12, the cartridge 40'" of the fourth preferred embodiment also incorporates a side slit 90 and side slit flap 91 identical in shape and function to that of the third preferred embodiment described with reference to FIG. 7 above. However, the size of the side slit 90 and side slit flap 91 are modified to accommodate larger bottles. Also, note that the access port 60'" is resized, as well, to accommodate larger bottles.

Figure 13:
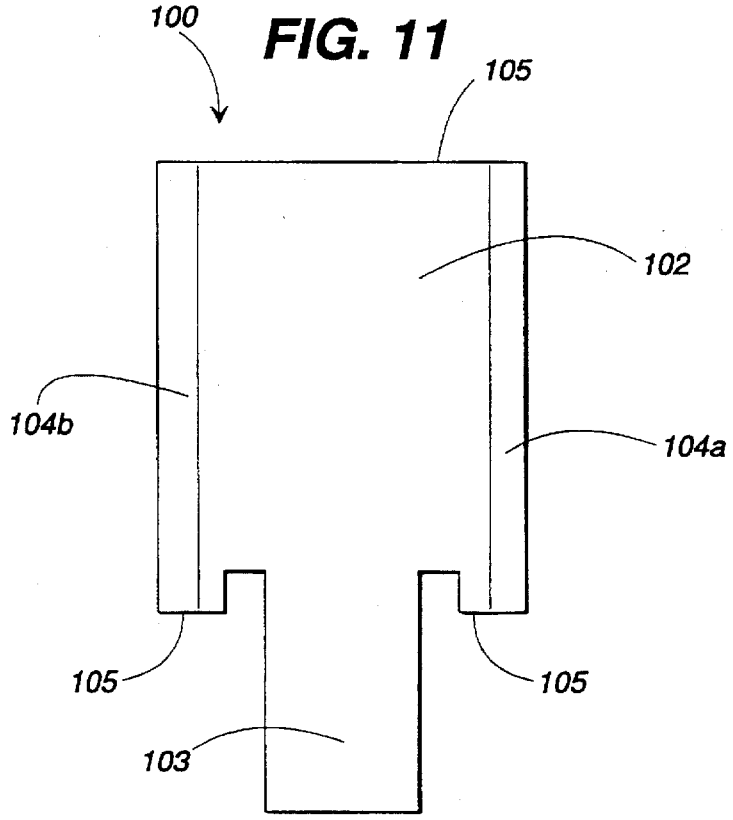
FIG. 13 is a flat pattern view of the back bottle ramp insert of the assembled cartridge apparatus of FIG. 12.

In accordance with a preferred method of the third preferred embodiment of the present invention, the inner and outer sleeves 42'", 44'" are cut and scored using patterns similar to those of FIGS. 9 and 10. After assembling the individual sleeves 42'", 44'", but before insertion of the inner sleeve 42'" into the outer sleeve 44'", the back bottle ramp 100 is cut and scored using the flat pattern depicted in FIG. 13. Note that in this figure, heavier weight lines indicate cut lines while lighter weight lines indicate fold lines. Once the back bottle ramp 100 is folded into shape, it is positioned inside the inner sleeve 42'". Product bottles are then stacked into the inner sleeve 42'" on top of one another. Some of the bottles rest on top of the lower portion 103 of the back bottle ramp 100 while others rest against the upper portion 102. The inner sleeve 42'" containing the back bottle ramp 100 and bottles is next inserted into the outer sleeve 44'". The side slit flap 91 is folded into the cavity 56" and assembly is completed by folding the flap 48*g* over the inner sleeve 42'" and downward into the cavity 56".

Figure 14:
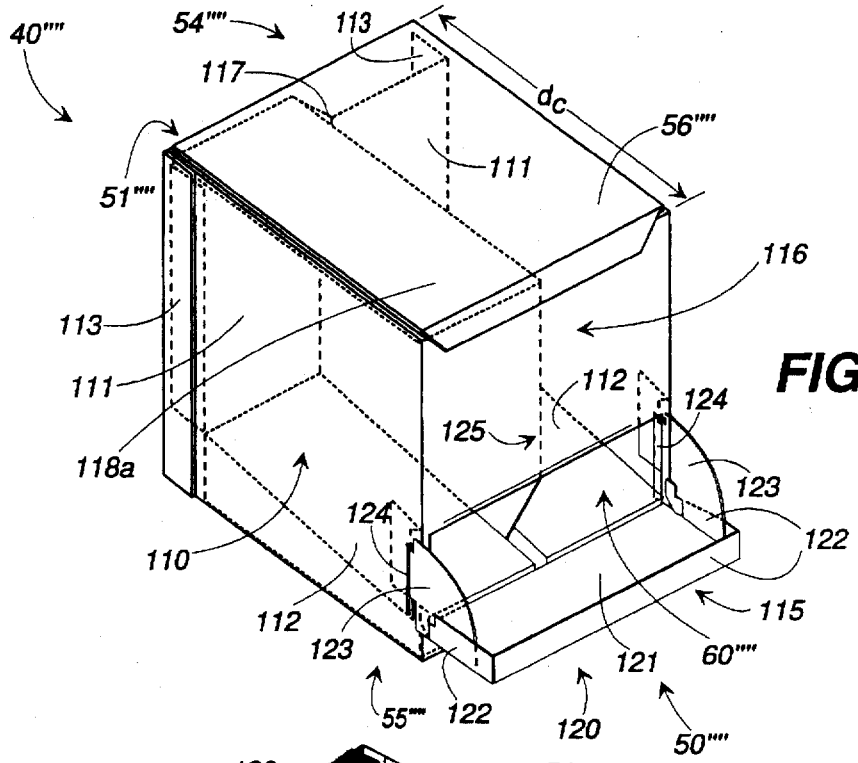
FIG. 14 is a side, perspective view of the assembled cartridge apparatus in accordance with a fifth preferred embodiment of the present invention.
Figure 15:
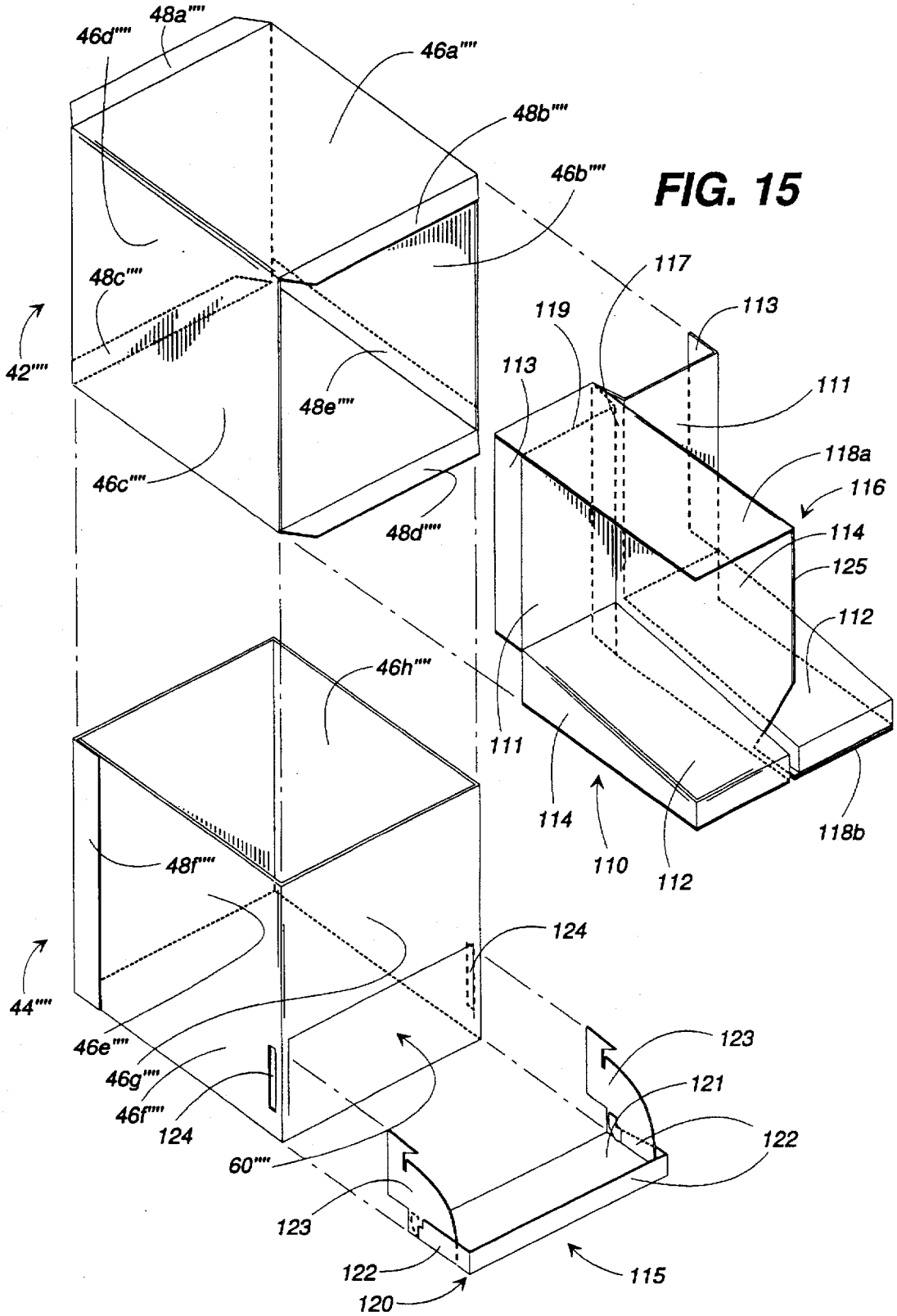
FIG. 15 is an exploded, side, perspective view of the assembled cartridge apparatus of FIG. 14.

Like the third and fourth preferred embodiments of the present invention, a fifth preferred embodiment of the apparatus of the present invention, shown in FIG. 14, is designed to display and dispense product packaged in small, lightweight bottles (not shown to improve clarity). Due to their shape, the bottles do not roll well. Therefore, in accordance with the fifth preferred embodiment of the present invention, the cartridge 40"" includes a false back/bottom 110 having an upper portion 111 that is spaced away from the back 51"" of the cartridge 40"" by flaps 113 to reduce the size of the cavity 56"" while maintaining the depth, $d_c$, of the cartridge 40"" at the same dimension as the majority of cartridges disclosed in the other preferred embodiments of the present invention. The false back/bottom 110 is displayed more clearly in the exploded view of FIG. 15. A lower portion 112 of the false back/bottom 110 is spaced away from the bottom 55"" of the cartridge 40"" by tapered flaps 114 and is thereby, slanted to aid in feeding the bottles onto a lip assembly 115 that is attached to the front 50"" of the cartridge 40"". To further aid in feeding bottles onto the lip assembly 115, FIGS. 14 and 15 display a z-shaped, center divider 116 that works in conjunction with the false back/bottom 110 to prevent the bottles from jamming in the cavity 56"" of the cartridge 40"". The center divider 116 has a panel 125 that rests in a groove 117 in the upper portion 111 of the false back/bottom 110 and is held in place by flaps 118*a,b* as shown in FIGS. 14 and 15. The upper flap 118*a* extends over an edge 119 of the false back/bottom 110 so that it lies, upon final assembly, between the top 54"" of the cartridge 40"" and the false back/bottom 110. The lower flap 118*b* extends under a side 119 of the false back/bottom 110 to lie, upon final assembly, between the bottom 55"" of the cartridge 40"" and the false back/bottom 110.

The front lip assembly 115, in accordance with the fifth preferred embodiment of the present invention, provides a shelf 120 onto which the bottles come to rest for easy access to consumers. The front lip assembly 115 is positioned at the front 50"" of the cartridge 40"" just below the access port 60"" so that a shelf bottom 121 and shelf sides 122 work in cooperation with the front 50"" of the cartridge 40"" to support the bottles. When it is fully deployed as seen in FIGS. 14 and 15, the front lip assembly 115 utilizes uniquely designed hinge flaps 123 that fit into cartridge notches 124 to secure it to the cartridge 40"" and lock it into the fully deployed position. Additionally, hinge flaps 123 and cartridge notches 124 enable the front lip assembly 115 to be positioned in an alternate configuration that protects the front lip assembly 115 during shipment of the cartridge 40"".

Figure 16:
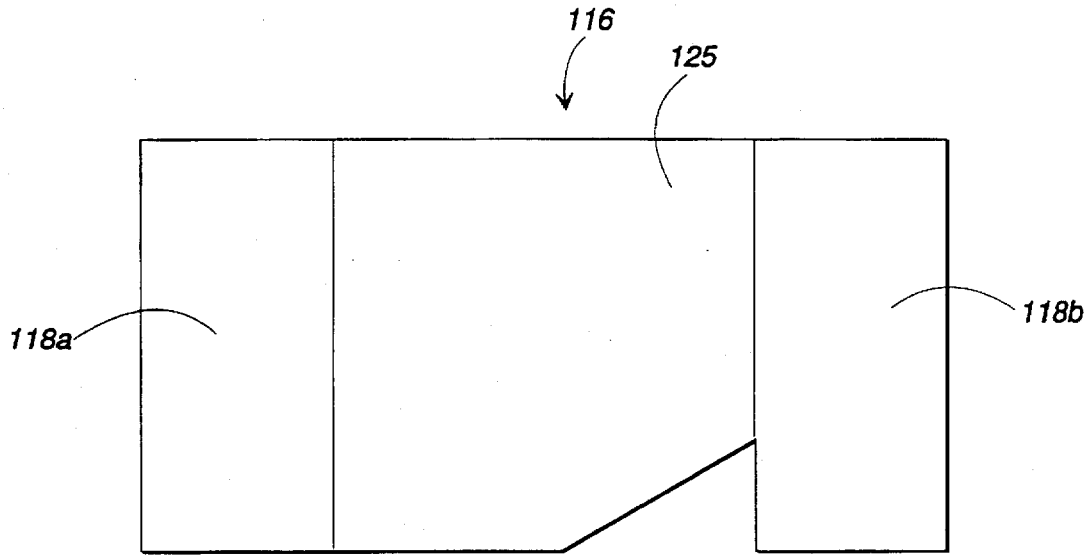
FIG. 16 is a flat pattern view of the center divider insert of the assembled cartridge apparatus of FIG. 14.
Figure 17:
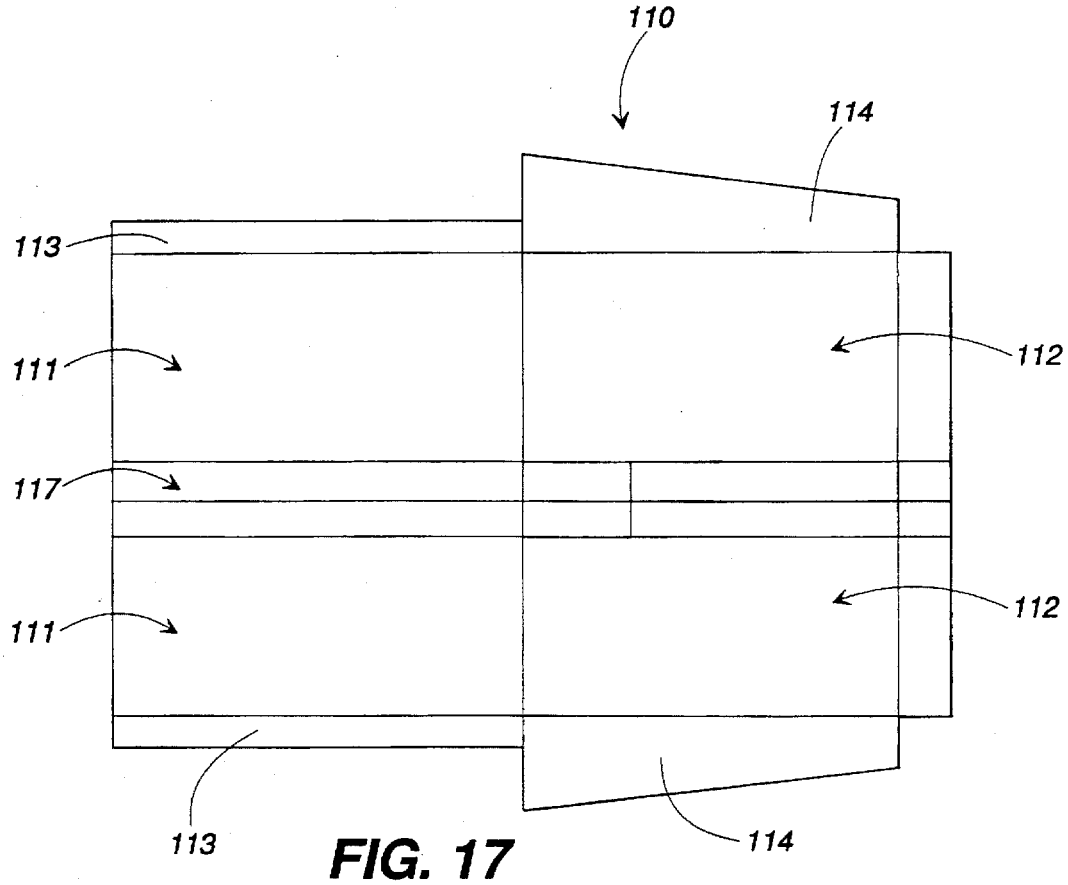
FIG. 17 is a flat pattern view of the false back/false ramp insert of the assembled cartridge apparatus of FIG 14.
Figure 18:
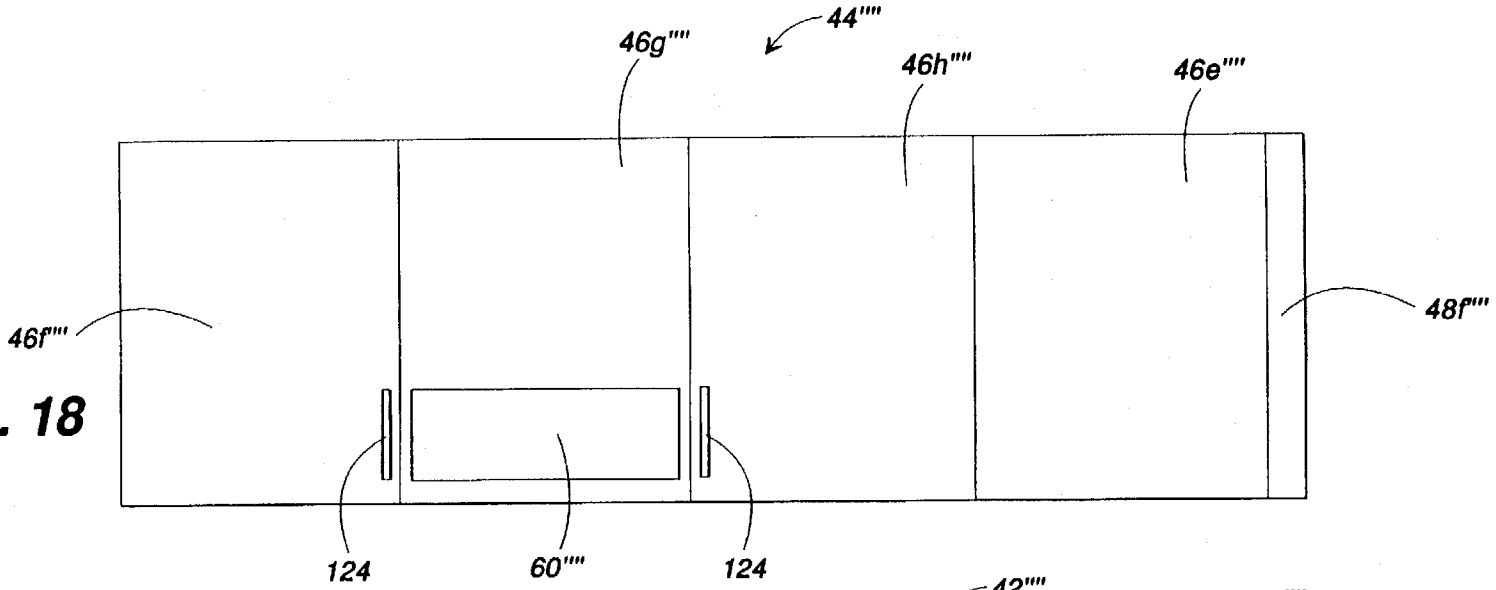
FIG. 18 is a flat pattern view of the outer sleeve of the assembled cartridge apparatus of FIG. 14.
Figure 19:
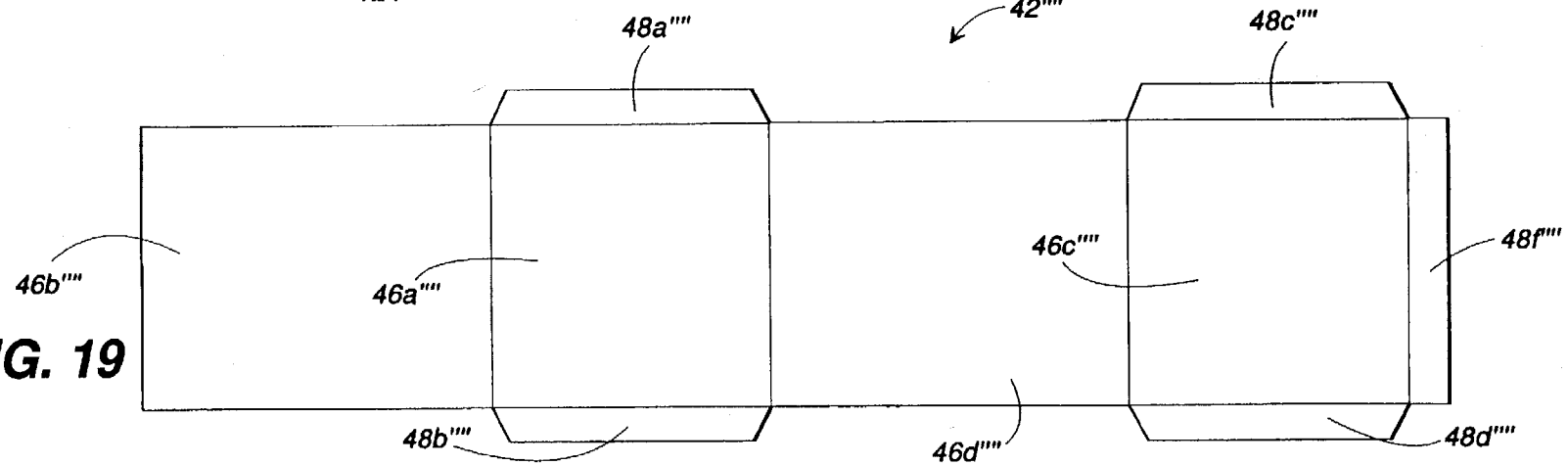
FIG. 19 is a flat pattern view of the inner sleeve of the assembled cartridge apparatus of FIG. 14.
Figure 20:
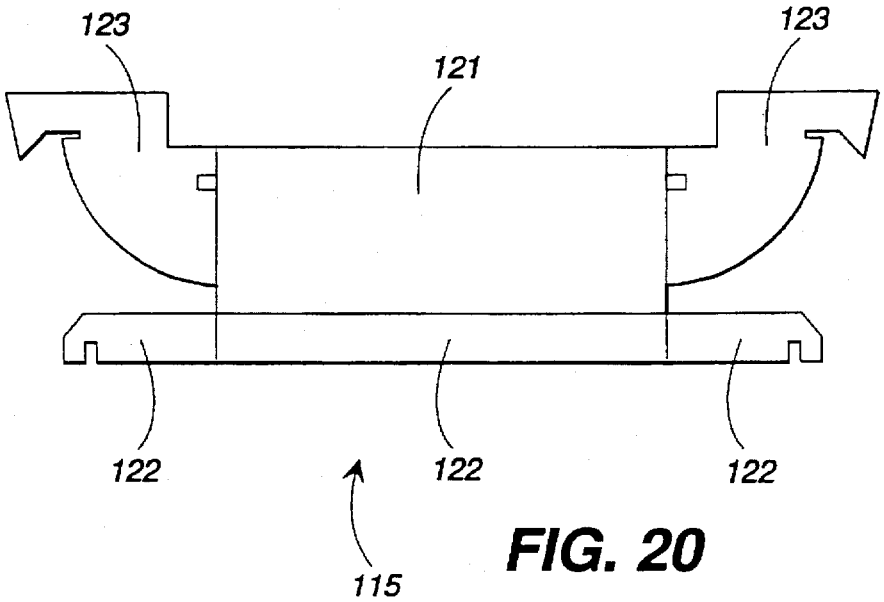
FIG. 20 is a flat pattern view of the front lip assembly of the assembled cartridge apparatus of FIG. 14.

In accordance with a preferred method of the fifth embodiment of the present invention, FIG. 16 displays a pattern for the center divider 116. Note that in this figure, the heavier weight lines indicate cut lines and the lighter weight lines indicate fold lines. The center divider 116 is cut and scored following the cut lines and fold lines of FIG. 16. It is then folded into the z-shape as displayed in FIGS. 14 and 15 and is set aside temporarily until the other parts of the cartridge 40"" are fabricated. Next, the false back/bottom 110 is cut and scored using the pattern of FIG. 17. As in FIG. 16, the heavier weight lines indicate cut lines and the lighter weight lines indicate fold lines. After folding the false back/bottom 110 into its completed shape, the panel 125 of the center divider 116 is inserted into the groove 117 of the false back/bottom 110 so that the flaps 118 are positioned as shown in FIGS. 14 and 15. Using the patterns of FIGS. 18 and 19, the outer sleeve 44"" and inner sleeve 42"" are assembled and set aside. In the figures, the heavier weight lines indicate cut lines, while the lighter weight lines indicate fold lines. The false back/bottom 110 and center divider 116 are then inserted into the inner sleeve 42"". After loading the cavity 56"" with bottles, the inner sleeve is inserted into the outer sleeve 44"". Finally, the front lip assembly 115 is cut and scored using the pattern of FIG. 20. As in FIGS. 16, 17, 18, and 19 the heavier weight lines indicate cut lines and the lighter weight lines indicate fold lines. Once folded as shown in FIGS. 14 and 15, the front lip assembly 115 is movably joined to the cartridge 40"" by inserting the hinged flaps 123 into the notches 124. For storage and shipping, the front lip assembly 115 is rotated up against the cartridge 40"" to reduce the size of the cartridge 40"" for efficient storage and to eliminate damage to the front lip assembly 115 during transportation. When subsequently set up for display, the front lip assembly 115 is rotated downward so that it locks into place. The cartridge 40"" is then ready for use.

Figure 21:
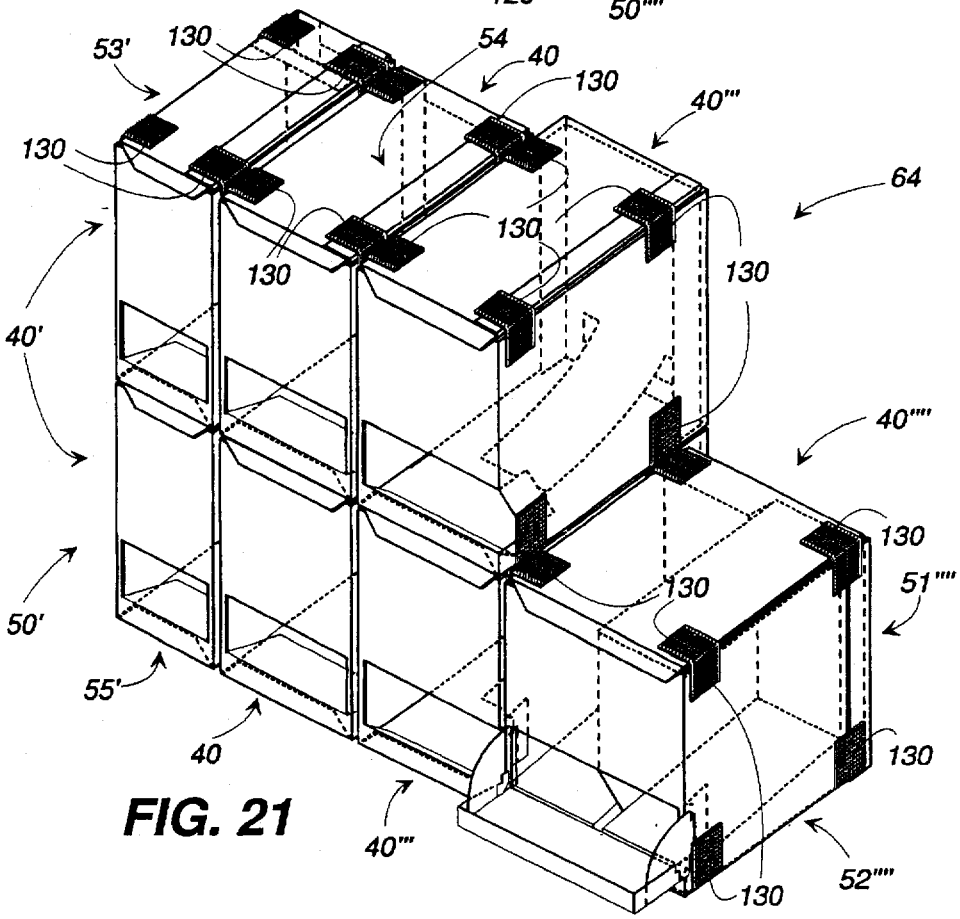
FIG. 21 is a side, perspective, view of the modular product display apparatus, in accordance with a preferred embodiment of the present invention, that displays the locations and use of fasteners.
Figure 22:
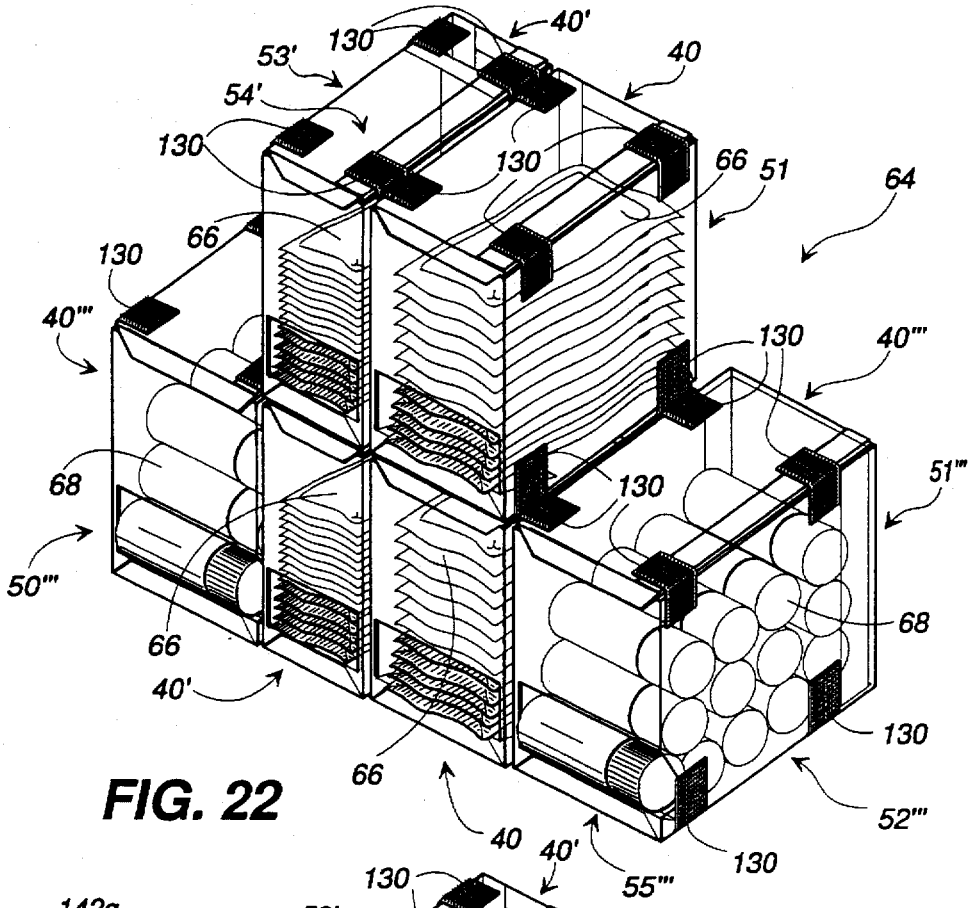
FIG. 22 is a side, perspective view of the modular product display apparatus, in accordance with a preferred embodiment of the present invention, where the individual cartridges contain product.
Figure 23:
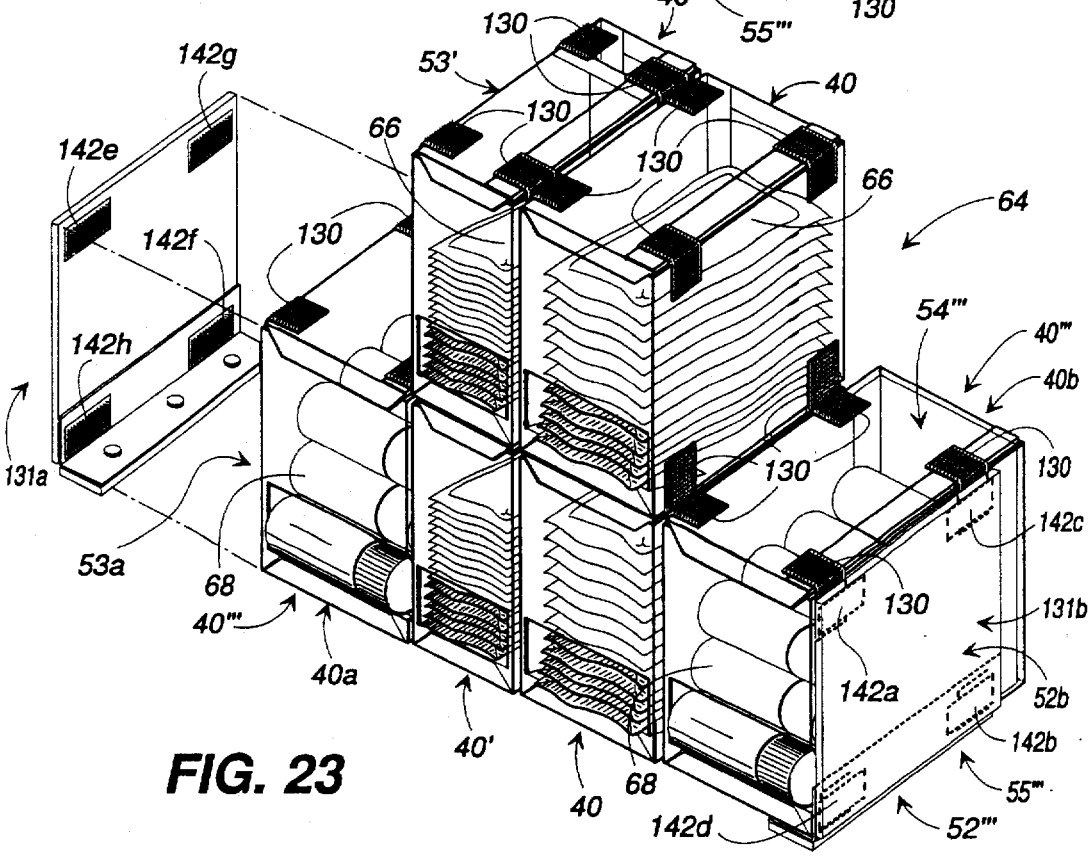
FIG. 23 is a side, perspective view of the modular product display apparatus, in accordance with a preferred embodiment of the present invention, that illustrates the locations of stabilizers.

Whereas, each cartridge 40 (40, 40', 40", 40'", 40"") is, itself, considered inventive, and can function as a stand-above product dispenser, an important (and, perhaps, most important) inventive aspect of the present invention is found in the modular and interactive system by which multiple cartridges cooperate to create a modular display 64. The modular nature of the apparatus of the present invention is depicted pictorially in FIGS. 21, 22, and 23. In these figures, the cartridges 40, 40', 40'", 40"" disclosed above by the preferred embodiments of the present invention are assembled into a modular display 64 for use in a store. Note that the Velcro™ fasteners 130, which were omitted in the earlier figures for clarity, are shown positioned on each cartridge 40 in eight locations that are, generally, near the front 50 and back 51 of each cartridge. Because FIGS. 21, 22, and 23 are perspective views, some of the fasteners 130 are hidden, but exist nonetheless, symmetrically located relative to the fasteners 130 that can be seen. It is important to note that all in this way, the fastners 130 of adjacent cartridges will be always aligned (i.e. in planes parallel to the front plane) in spite of unequal depths of various cartridges (see, for example, adjacent cartridges 40 and 40'" in FIGS. 21, 22, 23.) fasteners 130 are positioned at distances measured from the front plane of the cartridges. It is also important to note that an equivalent fastening mechansim may be used in lieu of Velcro™. In addition, as illustrated in FIGS. 21, 22, and 23, the fasteners 130 at each location extend from the sides 52, 53 to either the top 54 or bottom 55 of the cartridge 40.

Figure 24:
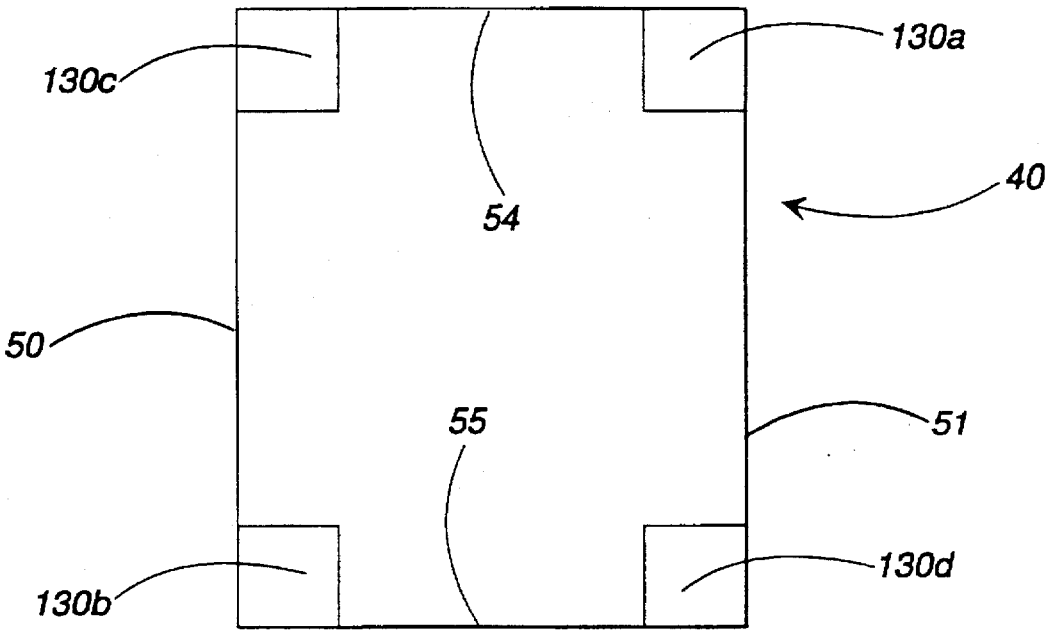
FIG. 24 is a schematic, right side view of an assembled cartridge showing the types and locations of fasteners.
Figure 25:
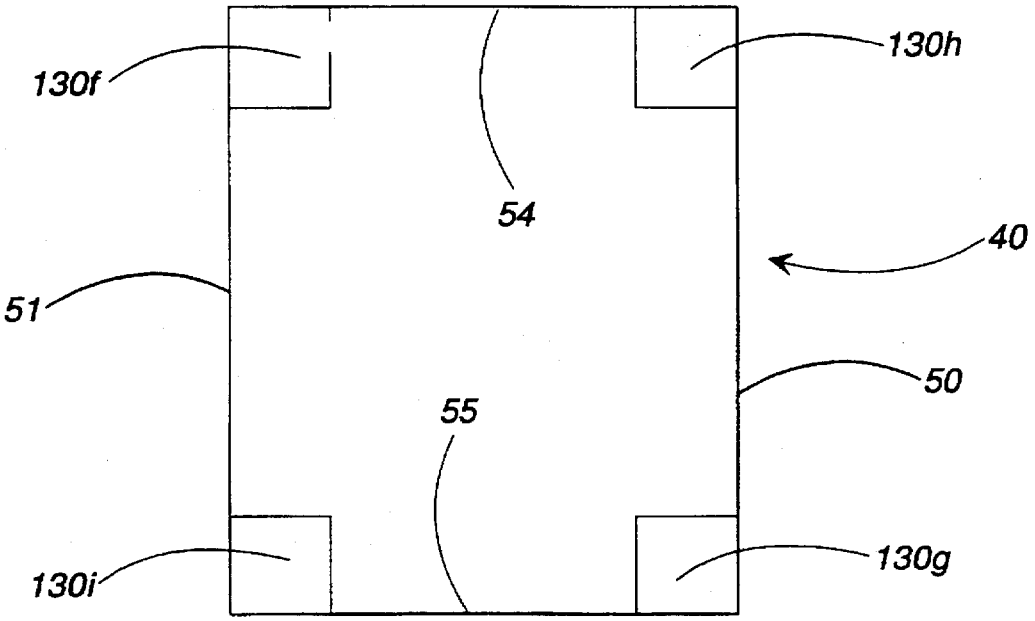
FIG. 25 is a schematic, left side view of an assembled cartridge showing the types and locations of fasteners.

To insure proper mating and joining of the cartridges 40 for variable assembly into modules or groups as shown in FIGS. 21, 22, and 23 in accordance with the preferred embodiments of the present invention, the fasteners 130 are specially oriented on each cartridge 40 as shown in FIGS. 24 and 25. More specifically, on the right side 52 of the cartridge 40 as shown in FIG. 24, fasteners 130*a,b* are hook fasteners, whereas fasteners 130*c,d* are loop fasteners. On the left side 53 of the cartridge 40 as shown in FIG. 25, fasteners 130*f,g* are loop fasteners, whereas fasteners 130*h,i* are hook fasteners. Using this orientation or pattern of hook and loop fasteners 130, any first cartridge 40 is matable with the right side 52, left side 53, top 54, or bottom 55 of any second cartridge 40. The inventive orientation of fasteners in FIGS. 24 and 25 allows for the creation of an endless number of different modular display arrangements and while other alternate patterns of hook and loop fasteners are possible, it is preferred that they provide a symmetrical pattern of fasteners if they are to subsequently enable the complete freedom of cartridge assembly into modules or groups.

Figure 26:
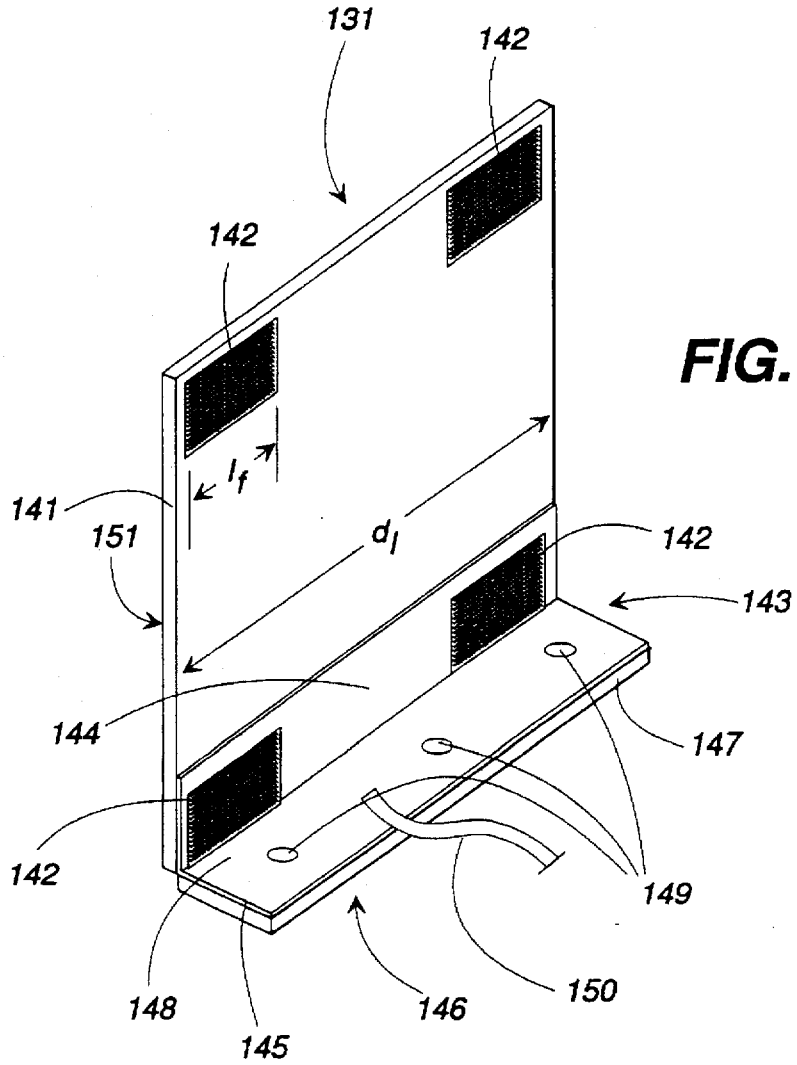
FIG. 26 is a side, perspective view of a stabilizer in accordance with a preferred embodiment of the present invention.

Referring to FIG. 23, the modular display of the present invention further includes, in an alternate embodiment, a pair of bookend stabilizers 131*a*, 131*b* abutting the outermost sides of the modular display 64. While the cartridges 40 are individually self-supporting, the stabilizers provide added support to the display 64 having multiple rows as shown in FIG. 23. In addition, the stabilizers 131 assist in preventing slippage of the modular display about a store counter. As shown in the perspective view of FIG. 26, each stabilizer is generally, L-shaped and has a vertical leg 141 that stands parallel to and mates with a cartridge side 52, 53. The vertical leg 141 is sized and shaped to accommodate the cartridges 40 disclosed above. Mating between the vertical leg 141 and cartridge 40 is accomplished via fasteners 142, for example, Velcro™ fasteners, positioned on the vertical leg 141 as shown in FIG. 26. Note that the pattern of hook and loop fasteners 142 on stabilizer 131*a* is arranged to engage the fasteners 130 on the left side 53 of cartridge 40. Similarly, note that (although hidden from view) the pattern of hook and loop fasteners 142 on stabilizer 131*b* is arranged to engage the fasteners 130 on the right side 52 of cartridge 40. Therefore, in accordance with the preferred embodiment of the present invention, fasteners 142*a, b,e,f* are hook fasteners and fasteners 142*c,d,g,h* are loop fasteners to insure complete cooperation and proper mating with all cartridges 40. It should be understood that this specification includes any other alternative, symmetrical patterns of hook and loop fasteners 142 that insure proper mating with the fasteners 130 of the cartridges 40. Also, note that each fastener 142 has its longest dimension, 1, oriented in the direction that establishes the depth, d, of the vertical leg 141. Orienting the fasteners 142 in this way enables the relationship of a vertical leg 141 and a cartridge 40 to be somewhat inexact during assembly of a modular display.

The stabilizer 131, shown in FIG. 26, also includes a low profile foot 143 that is made of a thin, lightweight, flexible material such as plastic. A first portion 144 of the foot 143 is rigidly attached to the vertical leg 141. A second portion 145 of the foot 143 bends away from the vertical leg 141 so that it is positioned partially under a cartridge 40 when a stabilizer 131 is mated with a cartridge 40. The second portion 145 of the foot 143 is fitted on its bottom 144 with a non-skid pad 145 and on its top 146, with a number or spacers 147. The non-skid pad 145 aids in preventing the stabilizer 131, and hence the joined modular display, from slipping on a countertop, while the spacers 147 serve to more equitably distribute the weight of the cartridge 40 and hence, across the non-skid pad 145. To stop store personnel from mistakenly disposing of a stabilizer 131 when an attached cartridge 40 is disposed of, an elastic member 148 is attached between the second portion 145 of the foot 143 of each stabilizer 131. Additionally, advertising panels (not shown) and money back guarantees (not shown) are attached to the outside 149 of the vertical legs 141.

In accordance with a preferred method of assembly and use of the display 64 of the present invention, the completed cartridges 40, disclosed in the preferred embodiments above, are shipped to a store where they are easily and quickly joined together like building blocks to form a modular display 64. Intermediate cartridges 40 are releasably joined to one another using the fasteners 130, while end cartridges 40 are releasably joined to the bookend stabilizers 131 for additional support. Using this method, a number of cartridges 40 are arrangeable by store personnel to fit within a small amount of counterspace or, for that matter, into virtually any configuration to eliminate cluttered store counters and to create an aesthetically appealing display. In an alternate method, a cartridge 40 is reversed to allow dispensing of the product only by store personnel.

Once a cartridge 40 is empty, store personnel remove the empty cartridge 40 from the modular display of FIG. 23 by unfastening it from the surrounding cartridges 40 and, if attached, from a stabilizer 131. The empty cartridge 40 is disposed of and is replaced by a new cartridge 40 that has been shipped directly to the store without the intervention of a route person. To install the new cartridge 40, the fasteners 130 of the new cartridge 40 are mated with those of other cartridges 40 and a stabilizer 131, if previously utilized, to rebuild the modular display.

Whereas this invention has been described in detail with particular reference to a preferred embodiment, it will be understood that variations and modifications can be effected within the spirit and scope of the invention, as described herein before and as defined in the appended claims.

I claim:

1. A product display and dispensing method comprising the steps of;

interconnecting a plurality of product dispenser cartridges, whereby a product display is initially defined, wherein each product dispenser cartridge abuts at least one other of the product dispenser cartridges and wherein a plurality of fastener devices positioned on each product dispenser cartridge cooperates with the plurality of fastener devices of at least one other of the product dispenser cartridges to which it is abutting to effect a releasable connection therebetween, selecting a product dispenser cartridge of the product display for replacement, disconnecting the plurality of fastener devices of the selected product dispenser cartridge of the product display from the plurality of fastener devices of other product dispenser cartridges of the product display to which it is abutting;

removing the selected product dispenser cartridge from the product display;

positioning a replacement product dispenser cartridge abutting at least one of the other product dispenser cartridges of the product display; and connecting the plurality of fastener devices of the replacement product dispenser cartridge to the plurality of fastener devices of at least one other of the product dispenser cartridges of the product display to which it abuts.

2. The method of claim 1, wherein the positioning step includes the step of positioning the replacement product dispenser cartridge at the former location within the product display of the selected product dispenser cartridge.

* * * * *